US009018550B2

(12) United States Patent
Kobayashi et al.

(10) Patent No.: US 9,018,550 B2
(45) Date of Patent: Apr. 28, 2015

(54) POWER SUPPLY CIRCUIT CUT-OFF DEVICE AND METHOD OF CONTROLLING POWER SUPPLY

(75) Inventors: Yutaka Kobayashi, Yokkaichi (JP); Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 345 days.

(21) Appl. No.: 13/489,659

(22) Filed: Jun. 6, 2012

(65) Prior Publication Data

US 2012/0318645 A1 Dec. 20, 2012

(30) Foreign Application Priority Data

Jun. 15, 2011 (JP) ..... 2011-133161

(51) Int. Cl.

| | |
|---|---|
| ***H01H 9/20*** | (2006.01) |
| ***H01H 31/00*** | (2006.01) |
| ***H01H 9/10*** | (2006.01) |
| ***H01H 9/00*** | (2006.01) |
| ***H01H 9/30*** | (2006.01) |
| ***H01R 13/53*** | (2006.01) |
| ***H01R 13/629*** | (2006.01) |
| *H01H 85/48* | (2006.01) |

(52) U.S. Cl.

CPC ..... *H01H 9/104* (2013.01); *H01H 9/0066* (2013.01); *H01H 9/30* (2013.01); *H01H 85/48* (2013.01); *H01H 2009/108* (2013.01); *H01R 13/53* (2013.01); *H01R 13/62938* (2013.01)

(58) Field of Classification Search

USPC ..... 200/43.01, 43.11–43.19, 50.01, 50.02, 200/50.1, 50.11, 50.12, 50.14, 50.16–50.19, 200/50.21, 335

See application file for complete search history.

(56) References Cited

U.S. PATENT DOCUMENTS

| | | | | |
|---|---|---|---|---|
| 3,716,684 | A * | 2/1973 | McMillen et al. | 200/50.21 |
| 6,366,449 | B1 | 4/2002 | Hashizawa et al. | |
| 2003/0057958 | A1 | 3/2003 | Fukushima et al. | |
| 2008/0185276 | A1 * | 8/2008 | Matsunaga et al. | 200/335 |

FOREIGN PATENT DOCUMENTS

| | | |
|---|---|---|
| JP | 2011-90902 | 5/2011 |
| WO | 2012063549 | 5/2012 |

* cited by examiner

*Primary Examiner* — Edwin A. Leon
*Assistant Examiner* — Anthony R. Jimenez
(74) *Attorney, Agent, or Firm* — Gerald E. Hespos; Michael J. Porco; Matthew T. Hespos

(57) ABSTRACT

A service plug includes a lever (30) supported on a cover (20) for movement between full and partial locking positions. A housing (90) is connectable to and separable from the cover (20) as the lever (30) is moved. Heavy current terminals (50) are disconnected from a power supply circuit in a separating process of the cover (20). A detection terminal (60) is switched from an ON-state to an OFF-state in the separating process of the cover (20). A stopper (40) contacts restricting walls (25) on the cover (20) to stop a movement of the lever (30) from the full locking position toward the partial locking position until the heavy current terminals (50) are disconnected from the power supply circuit after the detection terminal (60) is switched from the ON-state to the OFF-state in the separating process of the cover (20).

11 Claims, 49 Drawing Sheets

FIG. 49

CONNECTING PROCESS

| Operating State | (1) Partly Locked State | (2) Lever Partial Locking Release | (3) Detection Terminal ON | (4) Lever Full Locking Start | (5) Fully Locked State |
|---|---|---|---|---|---|
| Lever | Partial Locking Position | Partial Locking Release, Rotation Starts | During Rotation | Contact With Cover | Rotation Ends, Full Locking Posiiton |
| Connector Connection | Lightly Fitted | Connection Starts | During Connection | Connection Completed | Connection Position |
| Stopper | Initial Position | Initial Position | Initial Position | Movement Starts | Final Position |
| Heavy Current Terminal | Fitted | Fitted | Fitted | Fitted | Fitted |
| Detection Termnal | OFF | OFF | OFF | OFF | OFF |

FIG. 50

SEPARATING PROCESS

| Operating State | (5) Fully Locked State | (6) Lever Full Locking Release | (7) Detection Terminal OFF | (8) Delay | | (1) Partly Locked State |
|---|---|---|---|---|---|---|
| | | | | Delay Start | Stopper Movement | |
| Lever | Locked State | Full Locking Release, Rotation Starts | During Rotation | Rotation Stops | Rotation Resumes After Stopper Movement | Partial Locking Position |
| Connector Connection | Connection Completion | Separation Starts | During Separation | Separation Stops | Separation Resumes After Stopper Movement | Separation Completion |
| Stopper | Final Position | Final Position | Final Position | Final Position | From Final Position to Initial Position | Initial Position |
| Heavy Current Terminal | Fitted | Fitted | Fitted | Fitted | Fitted | Fitted |
| Detection Termnal | ON | ON | OFF | OFF | OFF | OFF |

POWER SUPPLY CIRCUIT CUT-OFF DEVICE AND METHOD OF CONTROLLING POWER SUPPLY

BACKGROUND OF THE INVENTION

1. Field of the Invention

The invention relates to a power supply circuit cut-off device capable of opening and closing a power supply circuit and to a method of controlling power supply.

2. Description of the Related Art

Japanese Unexamined Patent Publication No. 2011-90902 a power supply circuit cut-off device called a service plug. The power supply circuit cut-off device includes a housing with which a lever is rotatably assembled and a cover is fit to the housing. The cover and the housing are connected and separated by rotating the lever. A power supply terminal connected to the power supply circuit is provided in the housing and closes the power supply circuit. A relay capable of energizing and cutting off the power supply circuit is mounted in the power supply circuit. The relay sets the power supply circuit in an energizable state when a detection terminal mounted in the housing is set in an ON-state and cuts off the power supply circuit when the detection terminal is set in an OFF-state.

A switching operation by the relay takes a certain time and there is a slight lag between a timing when detection terminal is set in the OFF-state and a timing at which the power supply circuit is actually cut off. Accordingly, if the lever is rotated quickly, the power supply circuit is opened before being cut off and there is a possibility of a spark.

The present invention was completed in view of the above situation and an object thereof is to prevent generation of a spark in a separating process of separating a cover.

SUMMARY OF THE INVENTION

The invention relates to a power supply circuit cut-off device for opening and closing a power supply circuit. The device comprises a lever and a cover that supports the lever movably between first and second positions. The device also has a housing that is connectable to and separable from the cover as the lever is moved. The cover is separated from the housing by moving the lever from the second position to the first position. At least one power supply terminal is disconnected from the power supply circuit in a separating process of the cover for opening the power supply circuit. At least one detection terminal is switched from an ON-state to an OFF-state in the separating process of the cover. At least one stopper contacts at least one restricting wall on the cover to stop a movement of the lever from the second position to the first position until the power supply terminal is disconnected from the power supply circuit after the detection terminal is switched from the ON-state to the OFF-state in the separating process of the cover.

At least one relay may be provided to cut off the power supply circuit based on the detection terminal being switched from the ON-state to the OFF-state. The stopper may stop the movement of the lever from the second position to the first position at least until the relay cuts off the power supply circuit. According to this configuration, the relay reliably cuts off the power supply circuit by stopping the movement of the lever after the detection terminal is switched from the ON-state to the OFF-state. The power supply circuit then can be opened by disconnecting the power supply terminal from the power supply circuit. Therefore, a spark will not be generated.

The stopper may be assembled with the lever movably between an initial position where a movement of the lever is permitted and a final position where the movement of the lever from the second position to the first position is prevented. According to this configuration, the stopper can be moved to the final position by holding the stopper at the initial position relative to the lever and moving the lever from the first position to the second position.

The stopper that is at a position different from the initial position may return to the initial position by being engaged with the restricting wall at an initial stage of connection of the cover and move from the initial position to the final position at a final stage of connection of the cover. Accordingly, even if the stopper is assembled with the lever at a position different from the initial position, the stopper can be returned to the initial position by moving the lever from the one side to the other side.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE DRAWINGS

FIG. 49 is a table showing a connecting process.

FIG. 50 is a table showing a separating process.

DETAILED DESCRIPTION OF THE PREFERRED EMBODIMENTS

Figure 1:
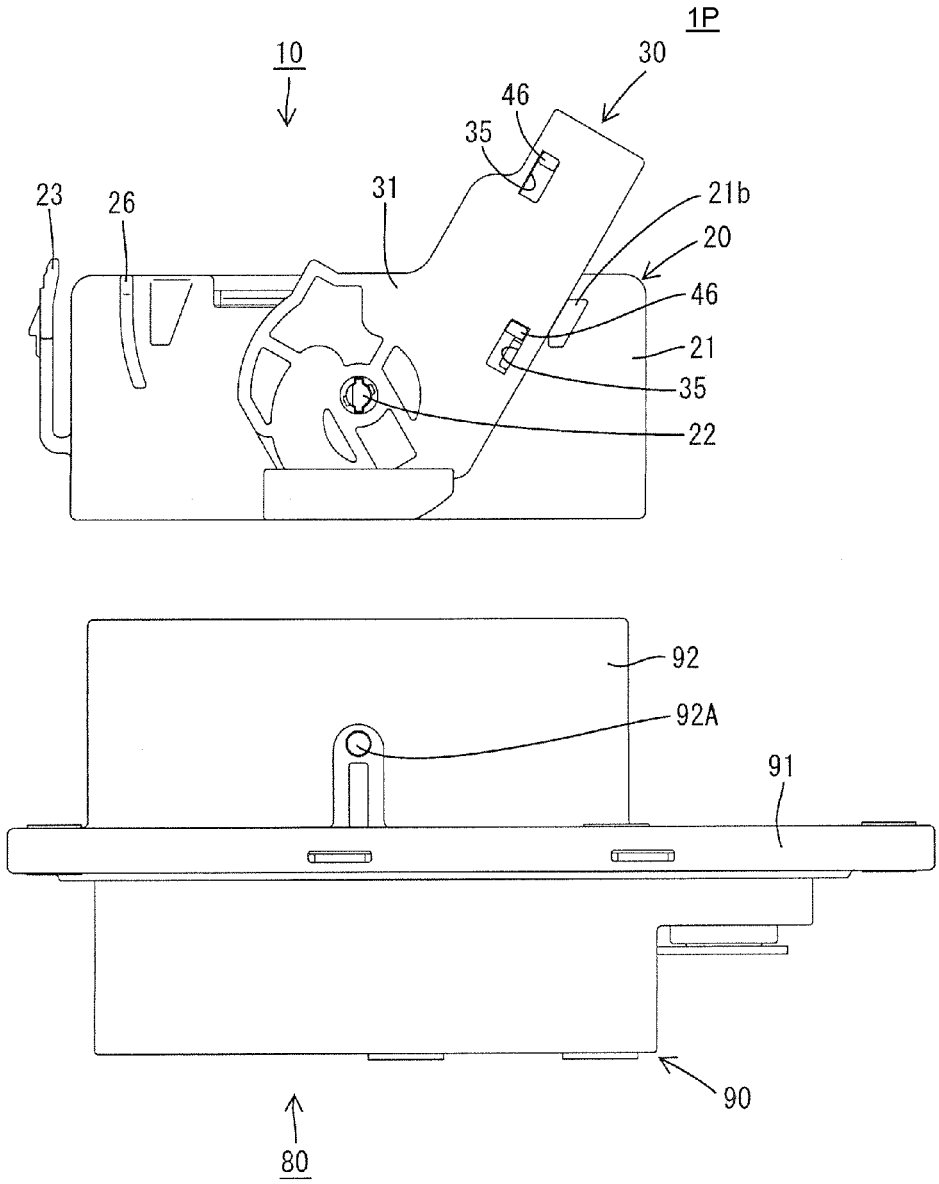
FIG. 1 is a front view showing a state where a lever is at a partial locking position (first position) and before a cover is connected to a housing.

A particular embodiment of the invention is described with reference to FIGS. 1 to 50. A service plug according to this embodiment comprises a cover-side connector 10 and a waiting-side connector 80 as shown in FIG. 1. The cover-side connector 10 includes a cover 20 and a lever 30. The cover 20 is connectable to and separable from the waiting-side connector 80 by rotating the lever 30. In the following description, ends of the cover 20 and the waiting-side connector 80 that connect to one another are referred to as fronts, the process of connecting the cover 20 to the waiting-side connector 80 is referred to as a connecting process of the cover 20 and the process of separating the cover 20 from the waiting-side connector 80 is referred to as a separating process of the cover 20.

The waiting-side connector 80 is connected to a power supply circuit for supplying power from a battery (not shown) provided in a vehicle such as an electric vehicle or a hybrid vehicle. Since the battery of this type has a larger capacity than those of normal gasoline-powered vehicles, maintenance particularly is performed after the power supply circuit is opened by removing the cover-side connector 10 from the vehicle such as in the case of maintenance of an electrical system. Specifically, the power supply circuit includes one or more heavy current terminals 50 provided in the cover-side connector 10. When the cover-side connector 10 is removed from the vehicle, the power supply circuit is opened and power supply from the battery is cut off, wherefore maintenance can be safely performed.

There is a possibility of a spark in the heavy current terminals 50 if the cover-side connector 10 is removed from the vehicle in a state where a current is flowing in the power supply circuit. Hence, a relay or power supply interrupter (not shown) is provided in advance in the power supply circuit as a means for cutting off the power supply circuit. The relay or the like cuts off the power supply circuit when a detection terminal 60 provided in the cover-side connector 10 is set in an ON-state, and sets the power supply circuit in an energizable state when the detection terminal 60 is set in an OFF-state. Thus, the power supply circuit can be cut off by setting the detection terminal 60 in the OFF-state before the power supply circuit is opened in the separating process of the cover 20 and can be set in the energizable state by setting the detection terminal 60 in the ON-state before the power supply circuit is closed in the connecting process of the cover 20.

The power supply circuit includes at least one fuse 70 provided in the cover-side connector 10. This fuse 70 includes a fusible element (not shown). When a high current substantially equal to or more than a rated current flow in the power supply circuit with the cover-side connector 10 mounted on the vehicle, the fusible element fuses or melts or is interrupted to cut off the power supply circuit, thereby protecting electrical devices connected to the power supply circuit. The fuse 70 is connected in series with the heavy current terminals 50. Therefore, even if the heavy current terminals 50 are connected to the power supply circuit, the power supply circuit is cut off if the fuse 70 blows out.

Figure 6:
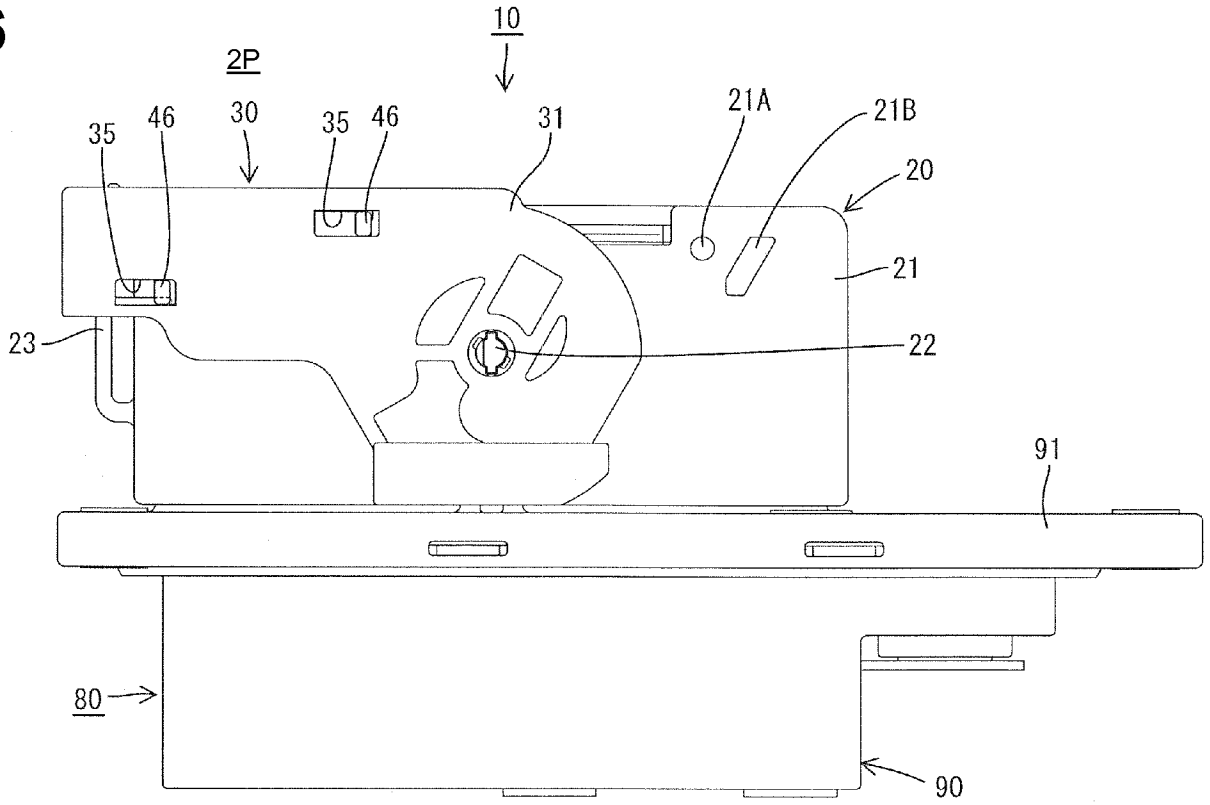
FIG. 6 is a front view showing a state where the lever is at a full locking position (second position) and after the cover is connected to the housing.
Figure 42:
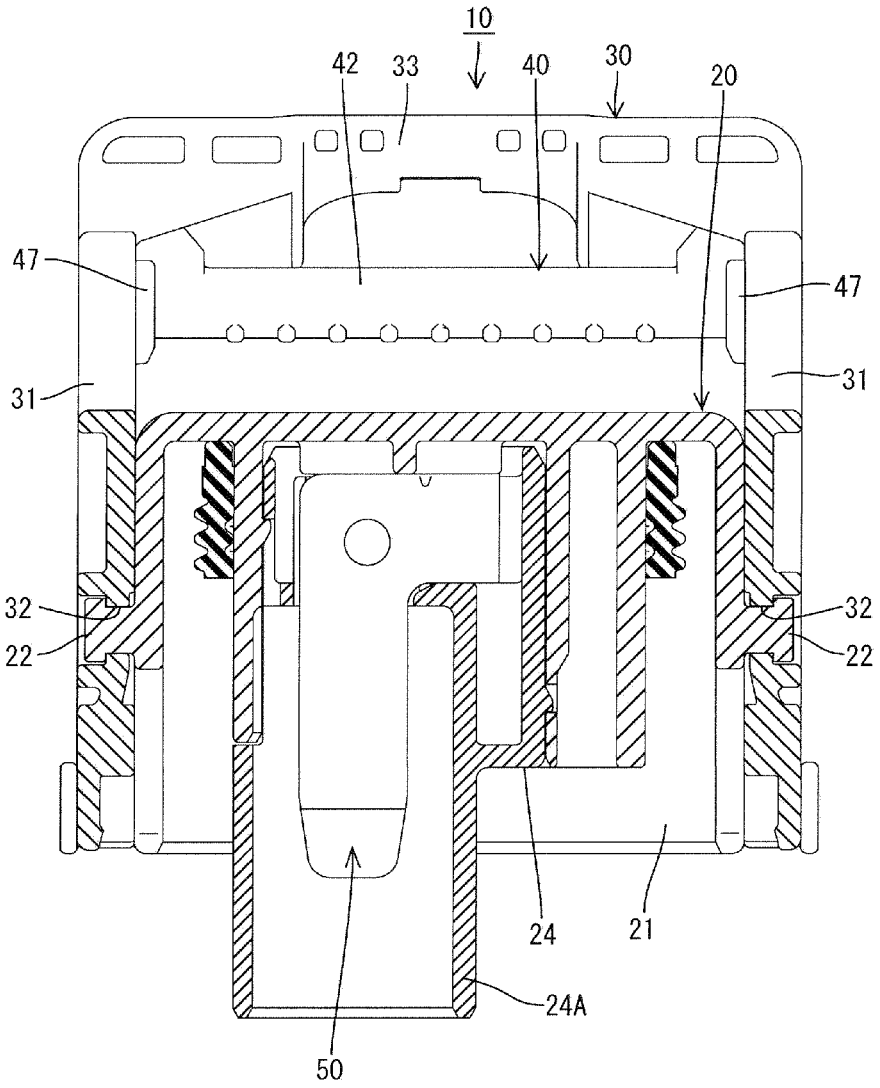
FIG. 42 is a section along D-D of FIG. 41.
Figure 43:
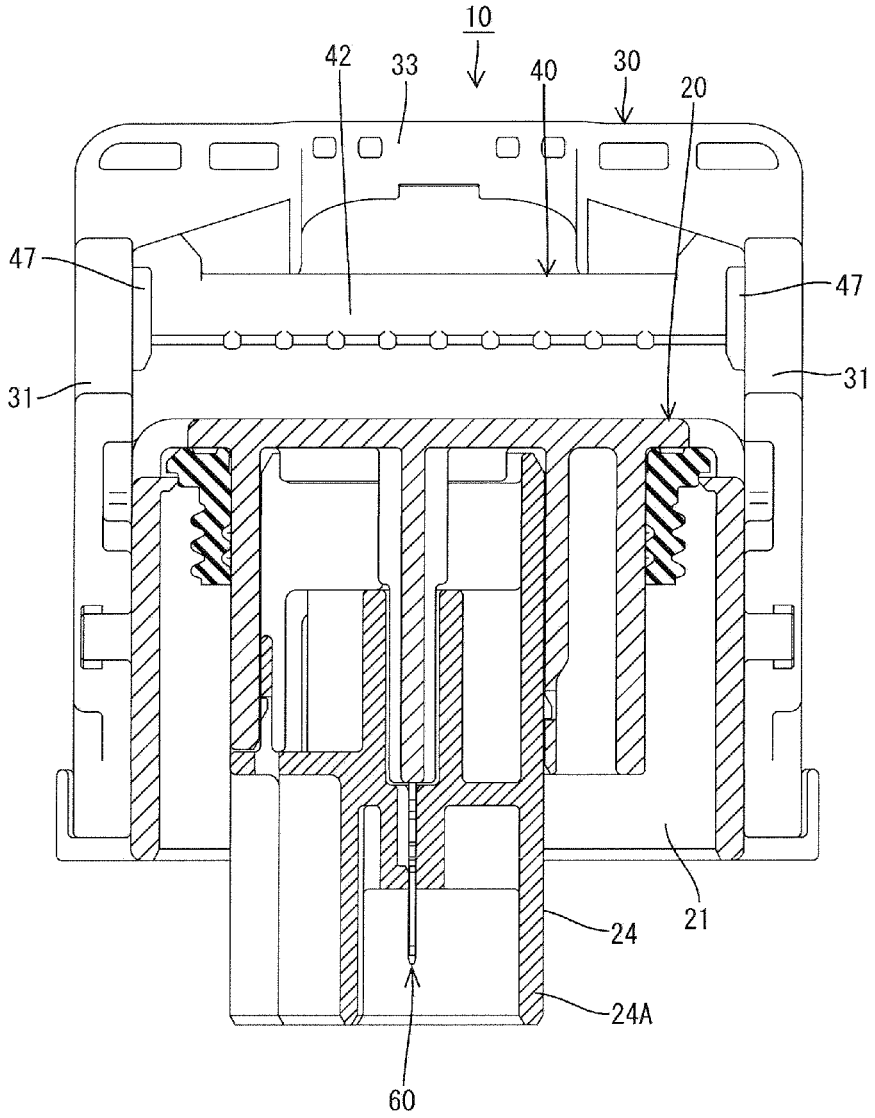
FIG. 43 is a section along E-E of FIG. 41.

Two supporting pins 22, 22 are provided on an outer peripheral wall 21 of the cover 20, as shown in FIG. 42. On the other hand, the lever 30 has two opposed cam plates 31, 31. The cam plates 31, 31 have supporting holes 32 to be supported rotatably on the supporting pins 22, 22. In this way, the lever 30 is supported on the cover 20 for rotation between a partial locking position 1P (as shown in FIG. 1) and a full locking position 2P (as shown in FIG. 6).

Figure 30:
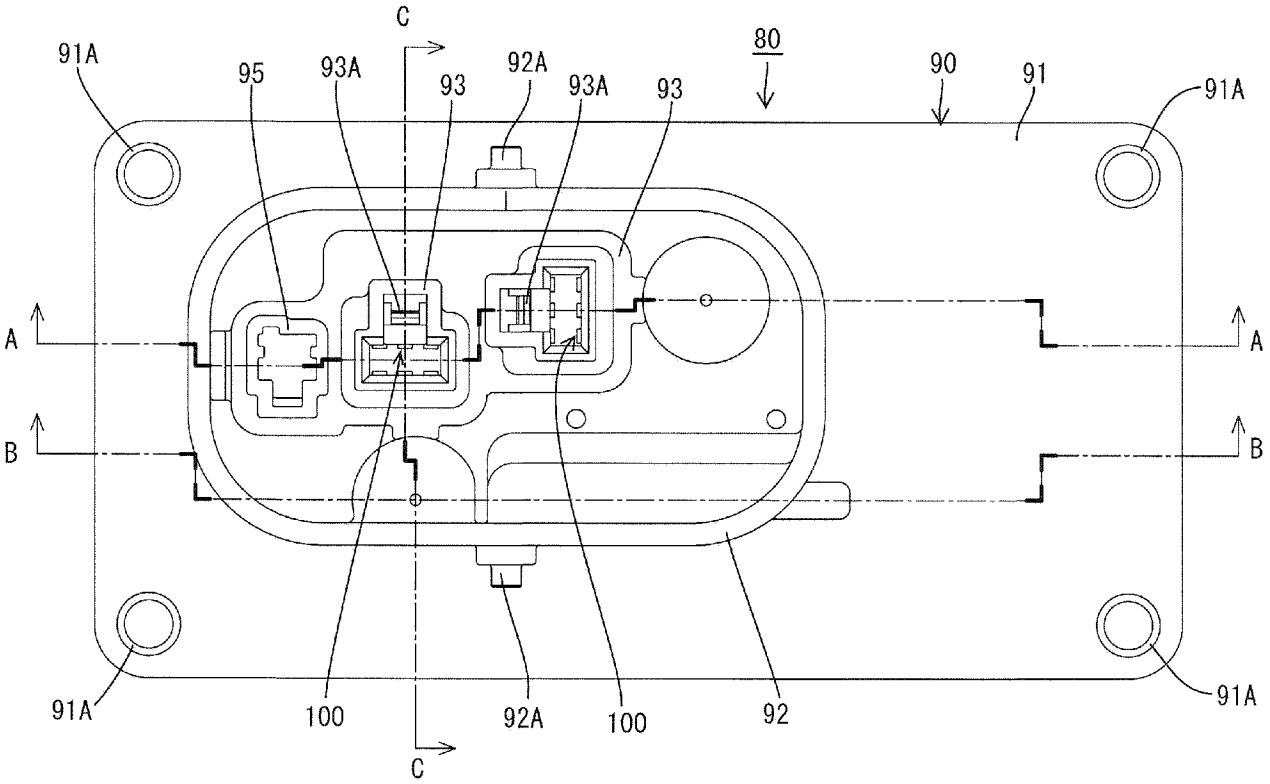
FIG. 30 is a plan view of a waiting-side connector.

The waiting-side connector 80 includes a housing 90 made e.g. of synthetic resin, as shown in FIG. 30. The housing 90 includes a mounting plate 91 to be mounted and fixed to a vehicle body (not shown), and a cover fitting 92 projecting forward from the mounting plate 91. The mounting plate 91 is substantially rectangular, and collars 91A are fixed at four corners of the mounting plate 91 by being press-fit or insert molded. Bolts are to be inserted into the collars 91A and tightened into the vehicle body, thereby fixing the waiting-side connector 80 to the vehicle body.

Figure 45:
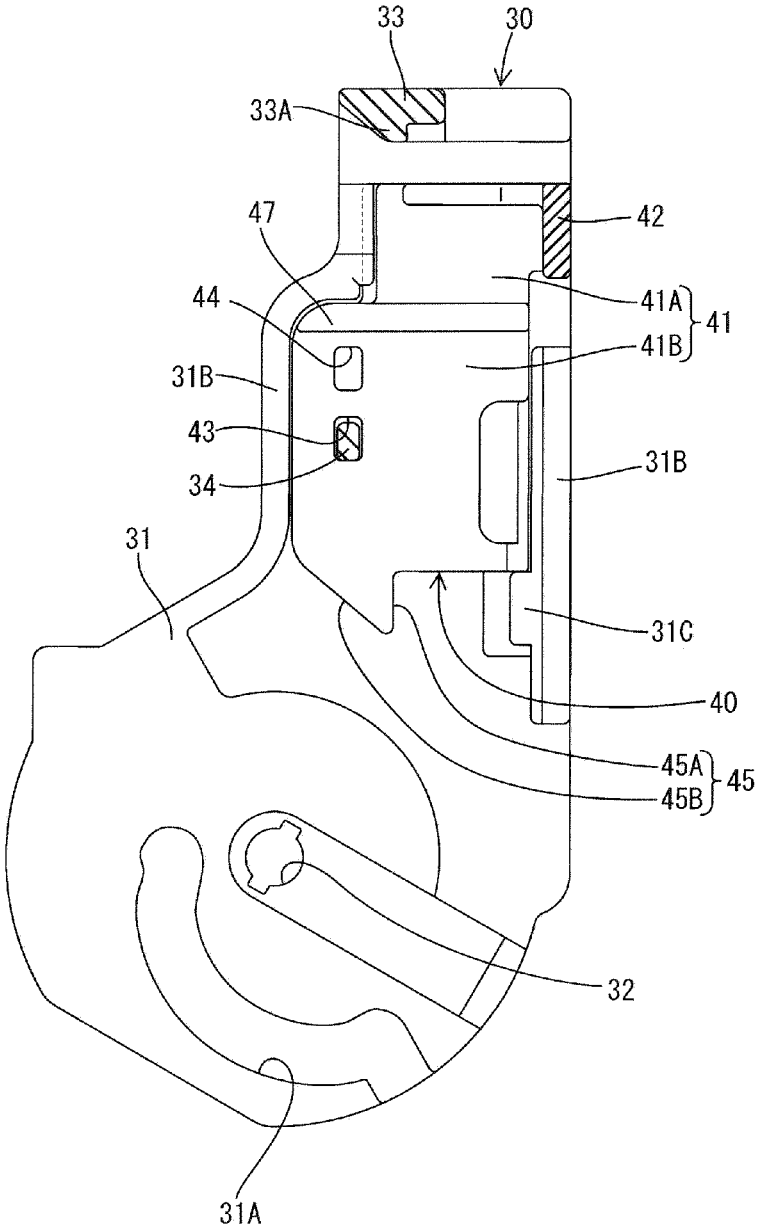
FIG. 45 is a side view showing the stopper at the initial position.

The cover fitting 92 is a forwardly open receptacle having an open front side, and two cam pins 92A, 92A are provided on the outer peripheral surface of the cover fitting 92. The cam pins 92A, 92A are arranged symmetrically with respect to an axis center of the cover fitting 92. On the other hand, facing surfaces of the cam plates 31, 31 of the lever 30 are recessed to form cam grooves 31A, 31A, as shown in FIG. 45. Each cam groove 31A extends from an entrance that is open on the outer peripheral edge of the cam plate 31, toward the supporting hole 32 in an arcuate manner. It should be understood that the invention is equally applicable to a lever having a single cam plate and one cam groove engageable with a single cam pin on the cover fitting.

The entrances of the cam grooves 31A, 31A align with the cam pins 92A, 92A in a connecting direction when the lever 30 is at the partial locking position 1P. The cover 20 then is fit lightly to the waiting-side connector 80 so that the cam pins 92A, 92A enter the entrances of the cam grooves 31A, 31A. The lever 30 then is rotated from the partial locking position 1P towards the full locking position 2P so that a cam action between the cam pins 92A, 92A and the cam grooves 31A, 31A pulls the cover 20 toward the waiting-side connector 80. Thus, the outer peripheral wall 21 of the cover 20 is fit properly to an outer peripheral side of the cover fitting 92.

Figure 24:
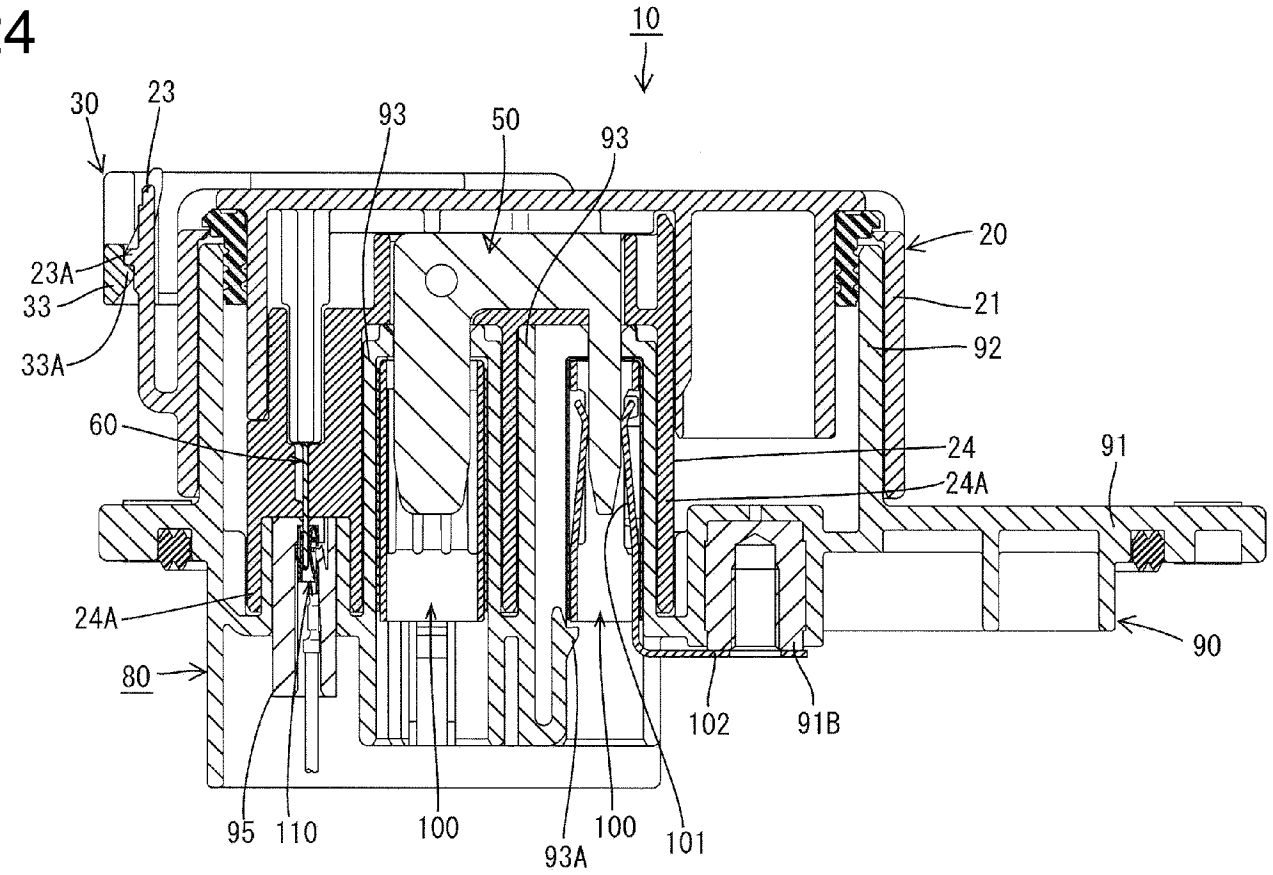
FIG. 24 is a section corresponding to FIG. 6, showing a fully locked state by the lever portion.

The lever 30 includes an operating portion 33 that connects the cam plates 31, 31 at positions spaced from the supporting holes 32, 32. Accordingly, the lever 30 is substantially U-shaped. The operating portion 33 can be engaged by fingers to rotate the lever 30. As shown in FIG. 24, the operating portion 33 faces the outer peripheral wall 21 of the cover 20 when the lever 30 is at the full locking position.

A resiliently deformable lever lock 23 is cantilevered from a surface of the outer peripheral wall 21 of the cover 20 facing the operating portion 33. A full locking projection 23A is provided on the outer surface of the lever lock 23 and is engageable with an engaging projection 33A on the operating portion 33. Accordingly, the full locking projection 23A and the engaging projection 33A interfere when the lever 30 is rotated from the partial locking position 1P to the full locking position 2P and the lever lock 23 deforms resiliently toward the outer peripheral wall 21. The lever lock 23 resiliently returns when the engaging projection 33A moves over the full locking projection 23A so that the full locking projection 23A engages the engaging projection 33A to lock the lever 30 at the full locking position 2P.

Figure 11:
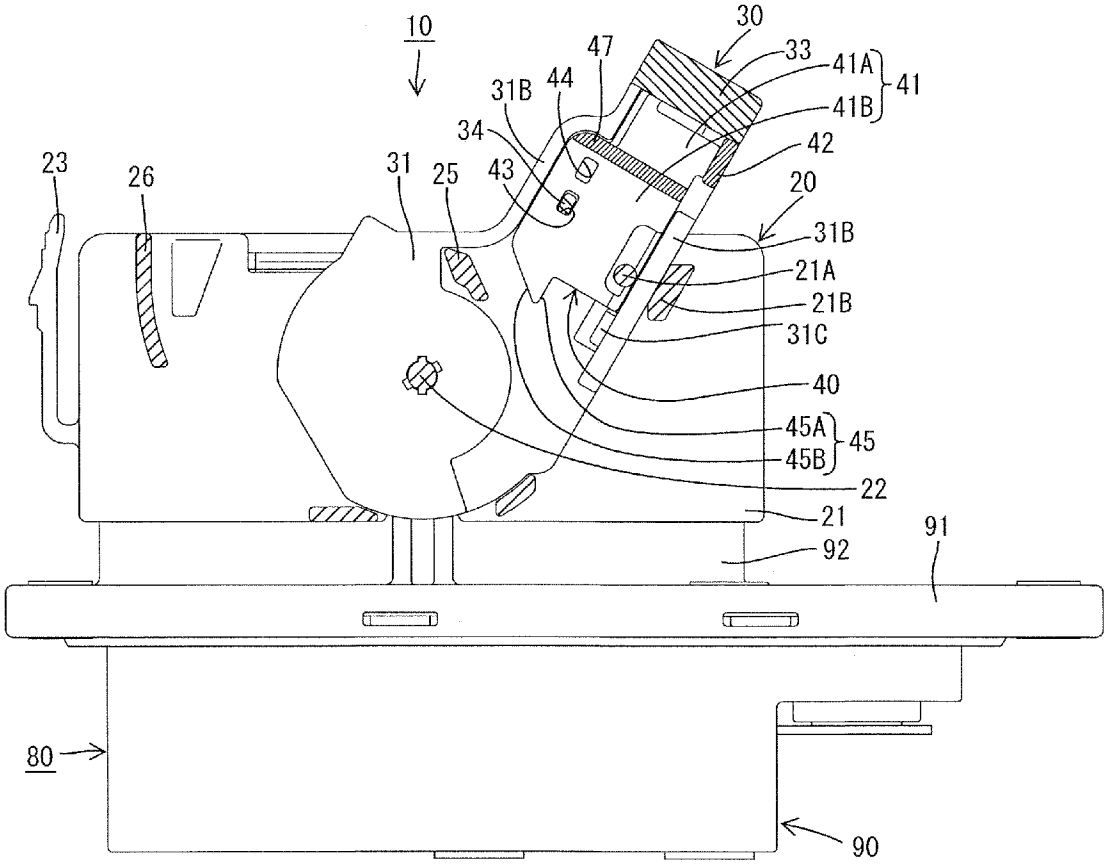
FIG. 11 is a section corresponding to FIG. 2, showing a state where the stopper is held at the initial position.

Partial locking projections 21A are provided on the outer peripheral wall 21 of the cover 20, as shown in FIG. 11, for holding the lever 30 at the partial locking position 1P. As shown in FIG. 45, two locking projecting edges 31B, 31B are provided on outer peripheral side edges of the facing surfaces of the cam plates 31, 31 of the lever 30. Each partial locking projection 21A is engaged with one of the locking projecting edges 31B to hold the lever 30 at the partial locking position 1P.

As shown in FIG. 30, two terminal accommodating portions 93 are provided in the cover fitting 92 for accommodating first and second intermediate terminals 100 inside. Each terminal accommodating portion 93 is a tube penetrating through the mounting plate 91 in a thickness direction and projects from the back side toward the front side of the cover fitting 92.

Figure 31:
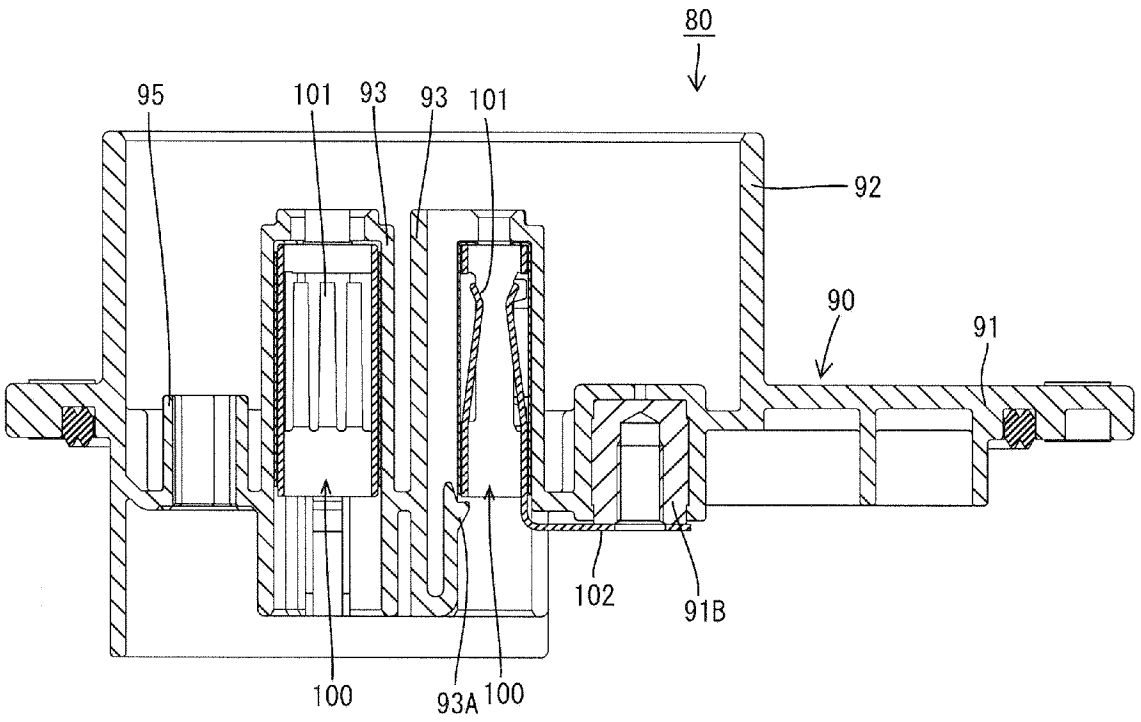
FIG. 31 is a section along A-A of FIG. 30.
Figure 32:
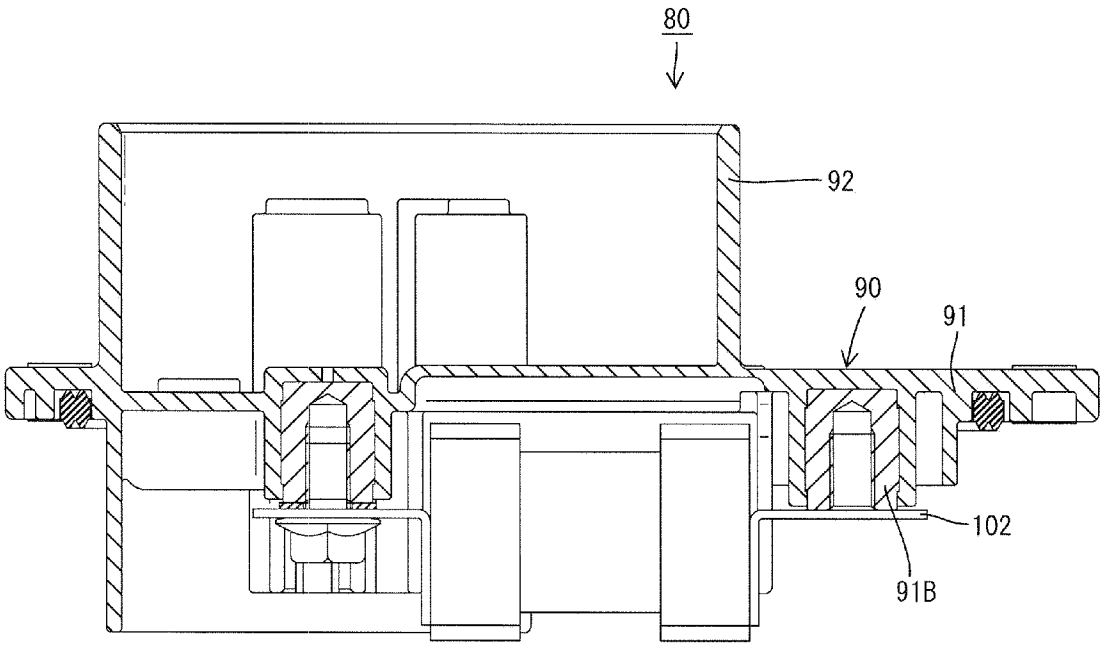
FIG. 32 is a section along B-B of FIG. 30.
Figure 33:
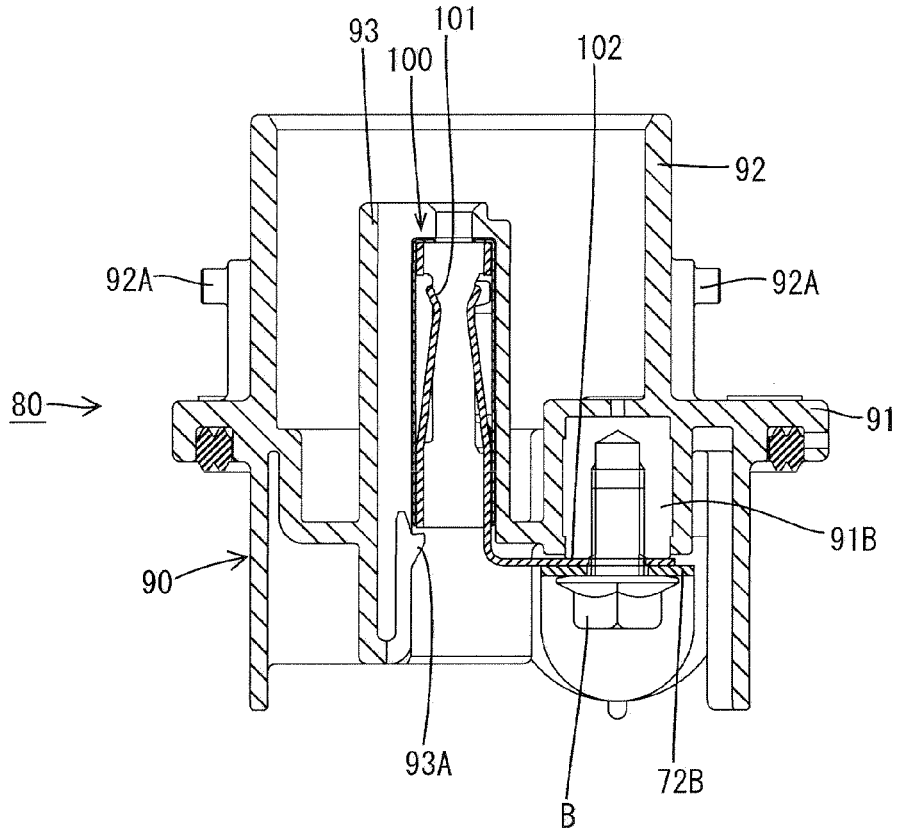
FIG. 33 is a section along C-C of FIG. 30.
Figure 34:
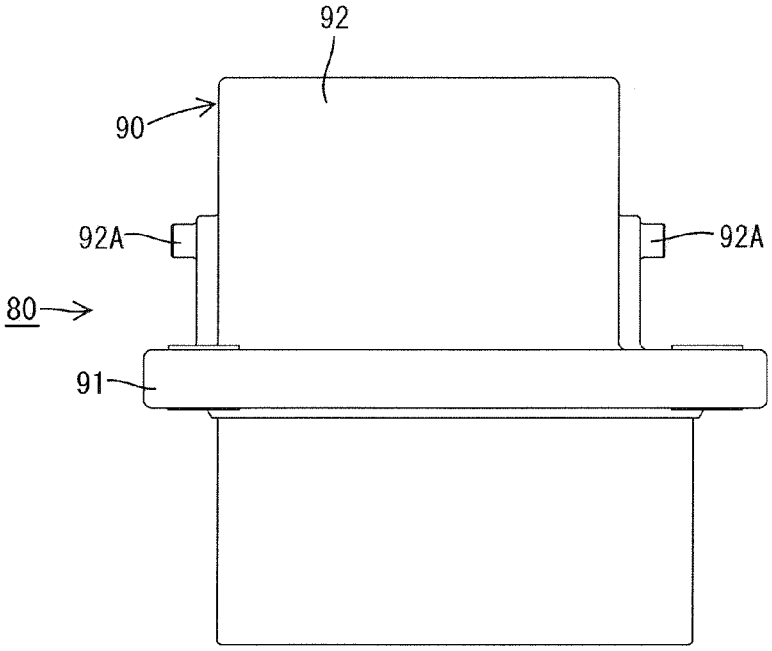
FIG. 34 is a left side view of the waiting-side housing.
Figure 35:
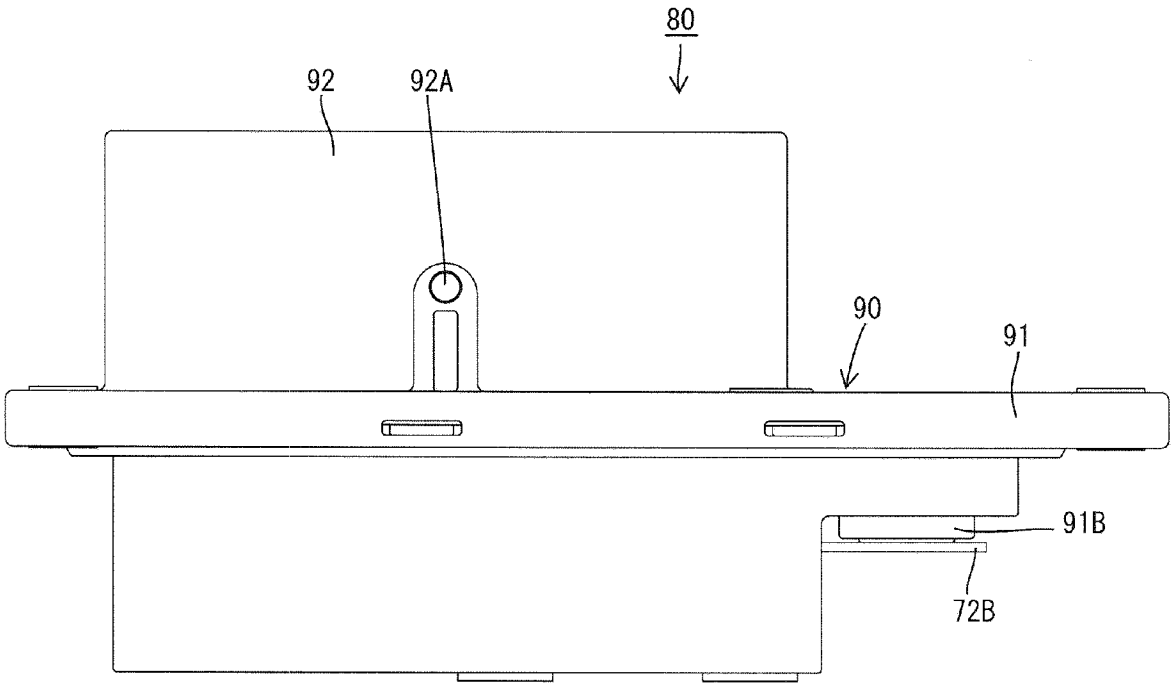
FIG. 35 is a front view of the waiting-side housing.
Figure 36:
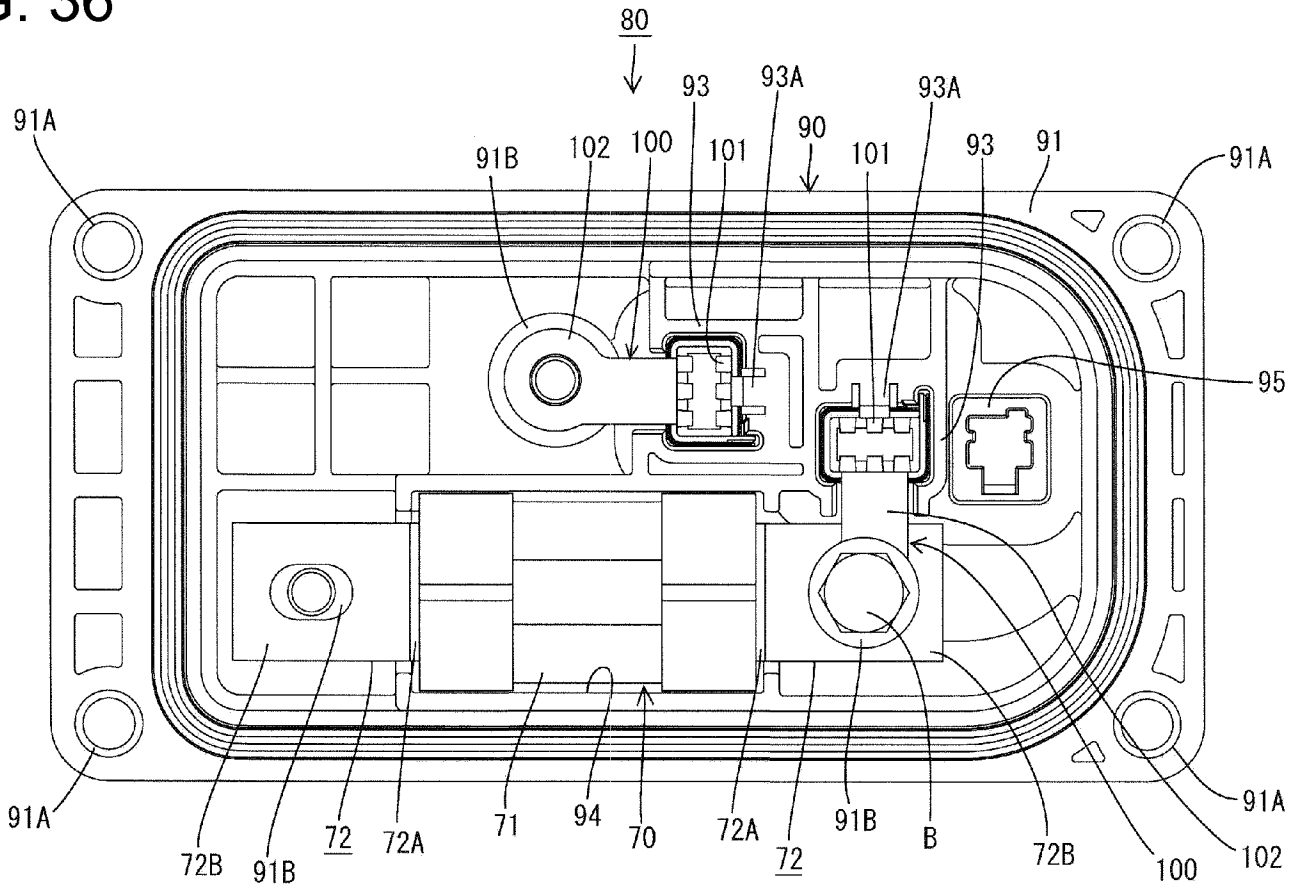
FIG. 36 is a rear view of the waiting-side housing.
Figure 37:
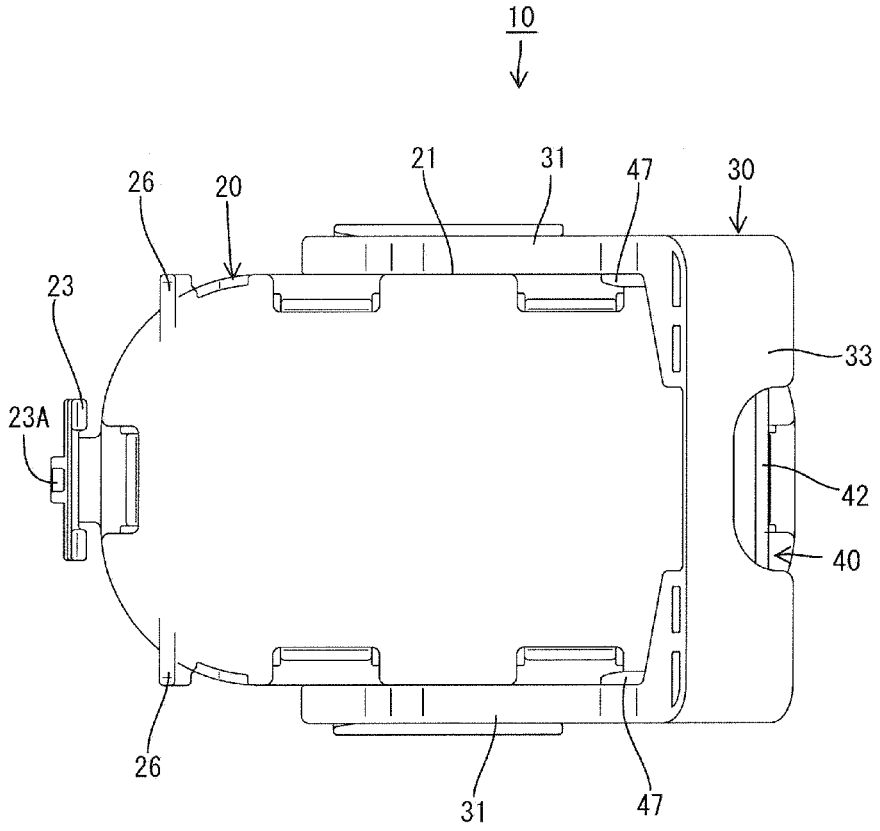
FIG. 37 is a plan view of the cover mounted with the lever.
Figure 38:
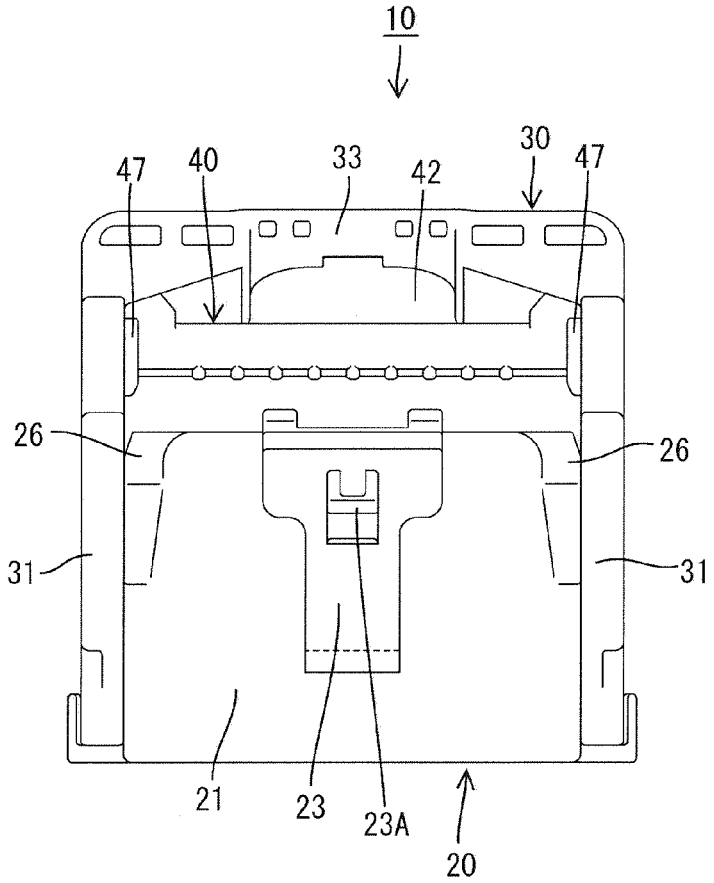
FIG. 38 is a left side view of the cover mounted with the lever.
Figure 39:
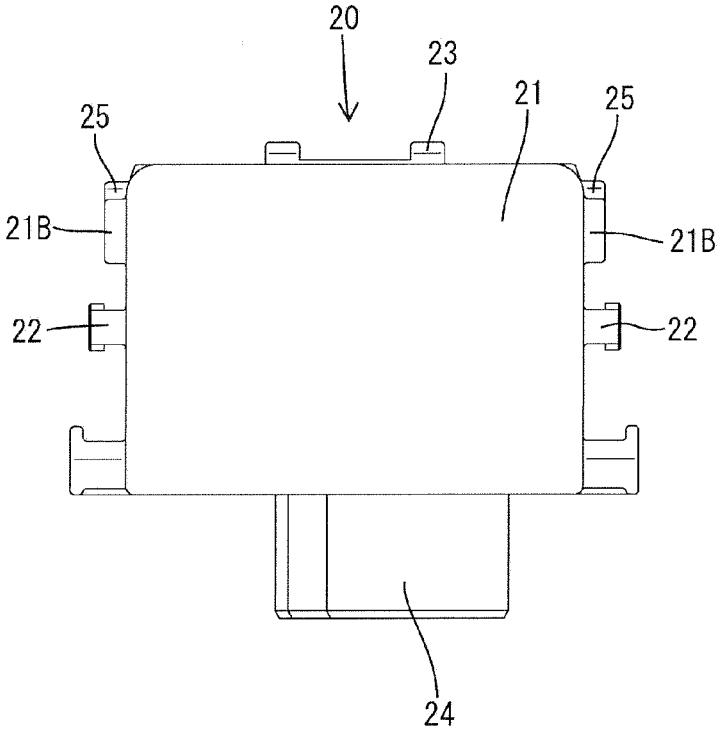
FIG. 39 is a right side view of the cover.
Figure 40:
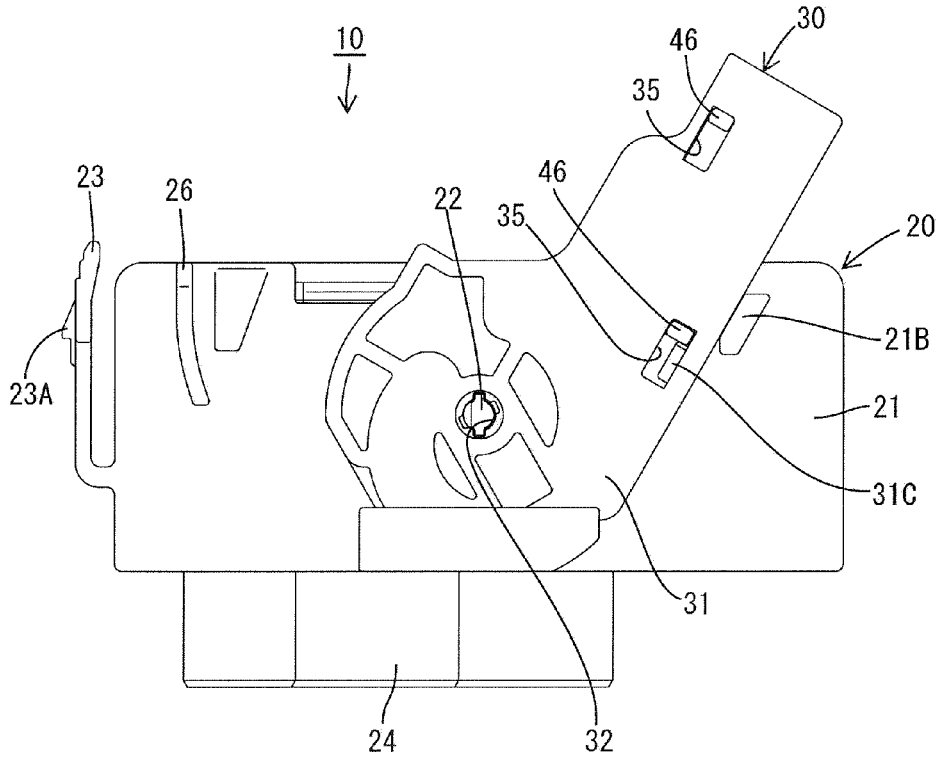
FIG. 40 is a front view of the cover mounted with the lever.

The intermediate terminal 100 comprises a cover-side connecting portion 101 arranged at the cover 20 and a vehicle-side connecting portion 102 arranged on the vehicle. As shown in FIG. 31, the cover-side connecting portion 101 is a substantially rectangular tube retained by a locking lance 93A in the terminal accommodating portion 93. On the other hand, as shown in FIG. 36, the vehicle-side connecting portion 102 is a substantially flat plate pulled out substantially parallel to the rear surface of the mounting plate 91. The vehicle-side connecting portion 102 extends to one of a plurality of bolt tightening seats 91B provided on the back surface of the mounting plate 91. Further, a fuse mounting portion 94 into which the fuse 70 is to be mounted is provided between the bolt tightening seats 91B, 91B on the back surface of the mounting plate 91.

The fuse 70 includes a tubular main portion 71 made e.g. of synthetic resin and accommodating an unillustrated fusible element, and two terminals 72 made of an electrically conductive metal plate. The terminals 72 are connected respectively to left and right ends of the main portion 71 and electrically conductively connected to each other through the fusible element. The terminal 72 comprises a first connecting portion 72A connected to the end of the main portion 71 and a second connecting portion 72B extending in an axial direction of the main portion 71 from one end of the first connecting portion 72A.

The second connecting portions 72B, 72B of the terminals 72, 72 extend respectively to two of the bolt tightening seats 91B. One second connecting portion 72B overlaps the vehicle-side connecting portion 102 of the first intermediate terminal 100. The second connecting portion 72B and the vehicle-side connecting portion 102 are to be fastened to the same bolt tightening seat 91B by a bolt B so that the first intermediate terminal 100 is connected to the fuse 70.

The other second connecting portion 72B that is not connected to the first intermediate terminal 100 and the vehicle-side connecting portion 102 of the second intermediate terminal 100 extend to different bolt tightening seats 91B. Two vehicle-side busbars (not shown) of the power supply circuit are arranged respectively on the bolt tightening seats 91B and are fastened by bolts. The cover-side connecting portions 101, 101 are connected electrically conductively by the heavy current terminal 50, as shown in FIG. 24. In this way, the respective vehicle-side busbars are connected in series via the at least one fuse 70, the first intermediate terminal 100, the heavy current terminal 50 and the second intermediate terminal 100 to close the power supply circuit.

A terminal holding portion 95 is provided in the cover fitting 92 separately from the terminal accommodating portions 93, 93 for holding a relay-side terminal 110. This terminal holding portion 95 penetrates the mounting plate 91 in the thickness direction. The relay-side terminal 110 held in the terminal holding portion 95 is to be connected to the detection terminal 60, as shown in FIG. 24. The relay switches the power supply circuit to the ON-state when the detection terminal 60 is connected to the relay-side terminal 110 and cuts off the power supply circuit when the detection terminal 60 is disconnected from the relay-side terminal 110 (OFF-state).

Figure 41:
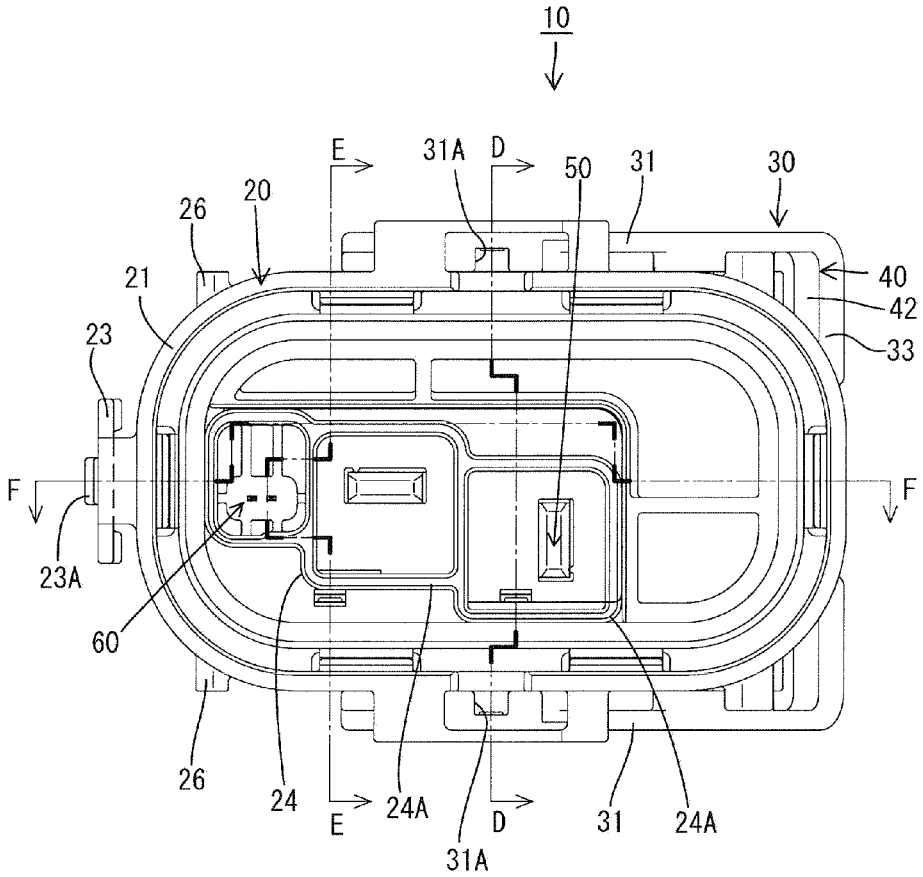
FIG. 41 is a bottom view of the cover mounted with the lever.
Figure 44:
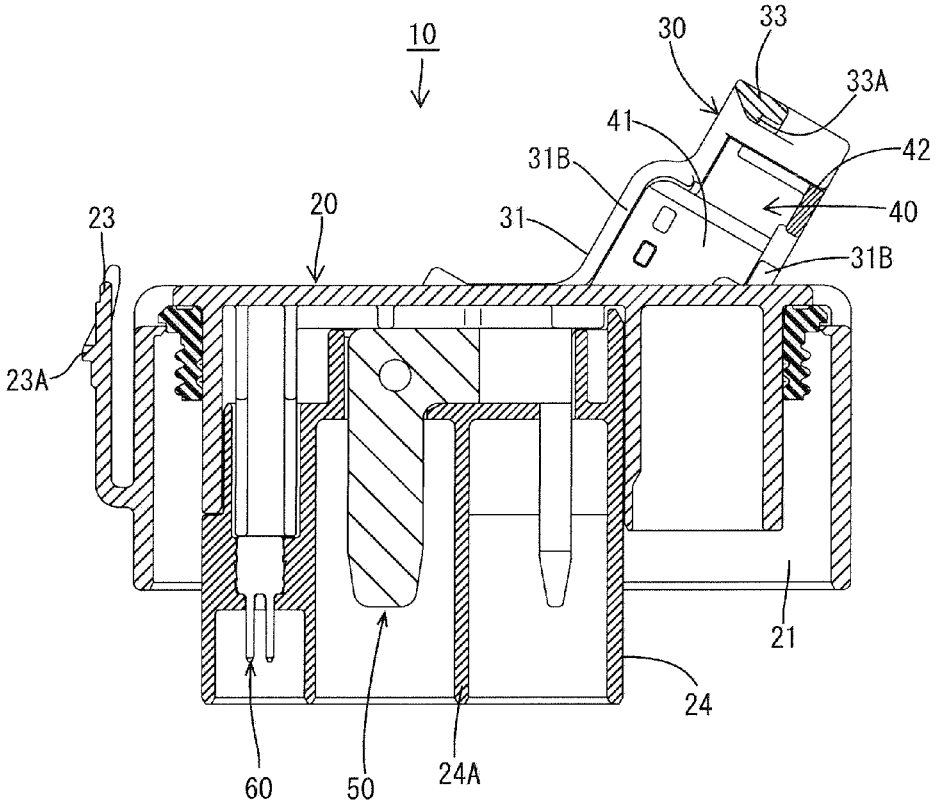
FIG. 44 is a section along F-F of FIG. 41.

Two heavy current terminals 50, 50 and the detection terminal 60 are collectively fixed in the cover 20 by a terminal mounting member 24, as shown in FIG. 41. This terminal mounting member 24 includes tubular fitting tubes 24A that project more forward that the opening edge of the cover 20, as shown in FIG. 44. The respective terminals 50, 60 are accommodated individually in the corresponding fitting tubes 24A. The terminal holding portions 95 are fit into the respective fitting tubes 24A, the heavy current terminals 50, 50 are fit into the respective intermediate terminals 100, 100 and the detection terminal 60 is fit into the relay-side terminal 110 when the cover 20 is connected properly to the waiting-side connector 80, as shown in FIG. 24.

Figure 47:
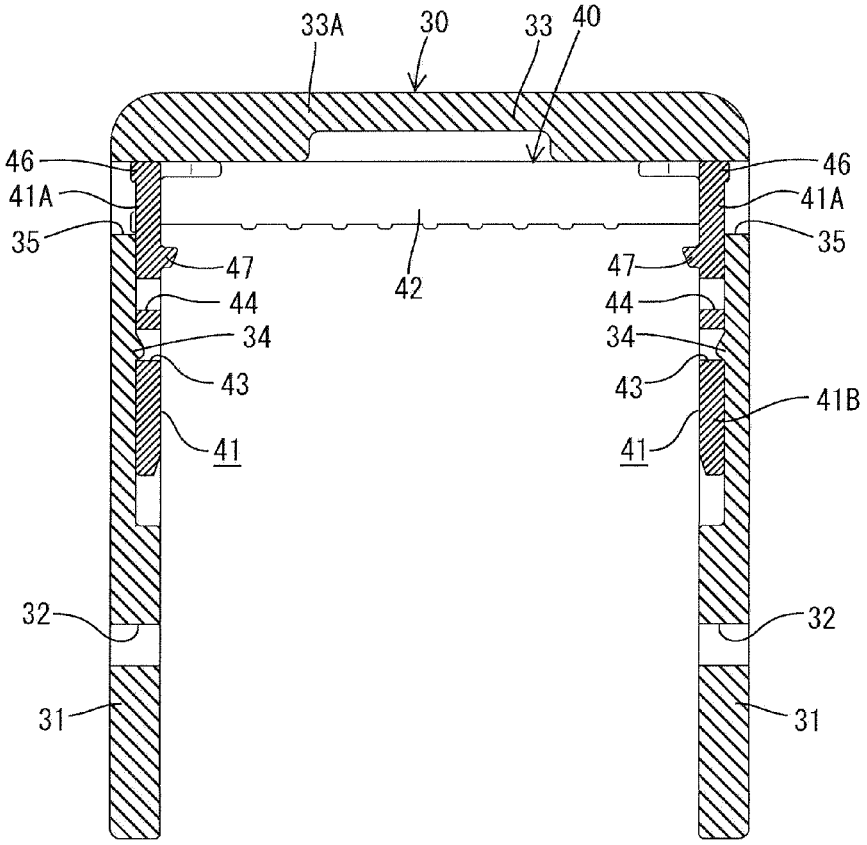
FIG. 47 is a section showing the stopper at the initial position.
Figure 48:
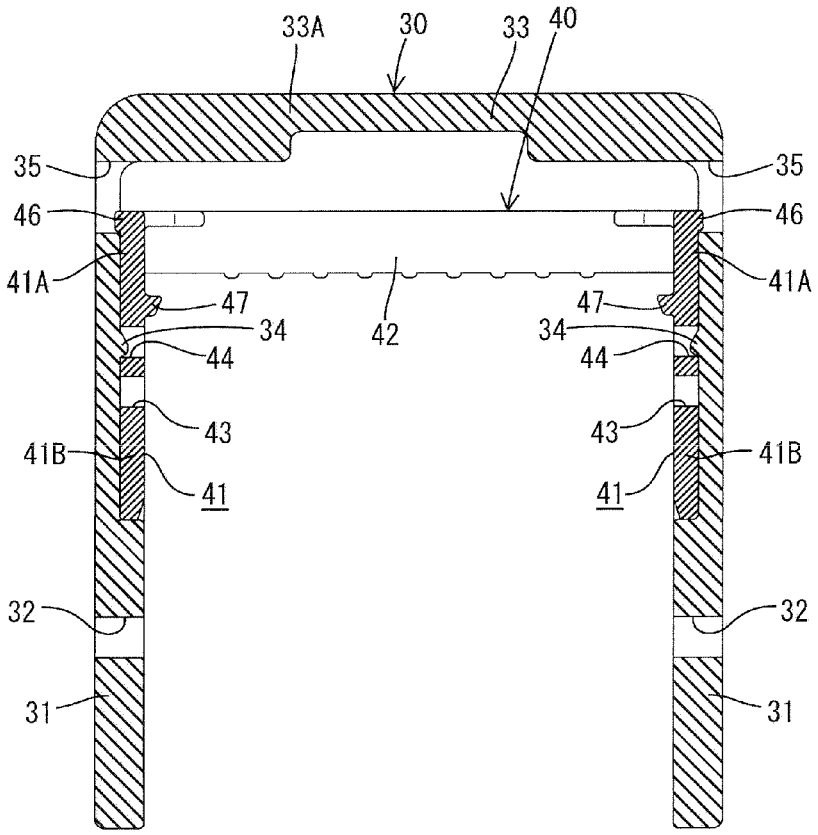
FIG. 48 is a section showing the stopper at the final position.

A stopper 40 is mounted at the inner side of the lever 30. The stopper 40 includes two slide plates 41, 41 arranged along the facing surfaces of the cam plates 31 and a coupling 42 coupling ends of the slide plates 41, 41, as shown in FIG. 47 to define a U-shape. The stopper 40 is made of synthetic resin and is vertically slidable between an initial position shown in FIG. 47 and a final position shown in FIG. 48.

As shown in FIG. 45, the slide plate 41 is accommodated between the locking projecting edges 31B, 31B with respect to a width direction and within a projecting height range of the both locking projecting edges 31B, 31B with respect to the thickness direction. The slide plate 41 comprises a narrow portion 41A arranged at an upper side and a wider portion 41B at a lower side. Note that the left side in FIG. 45 is referred to as the front and the right in FIG. 45 is referred to as the rear.

Figure 46:
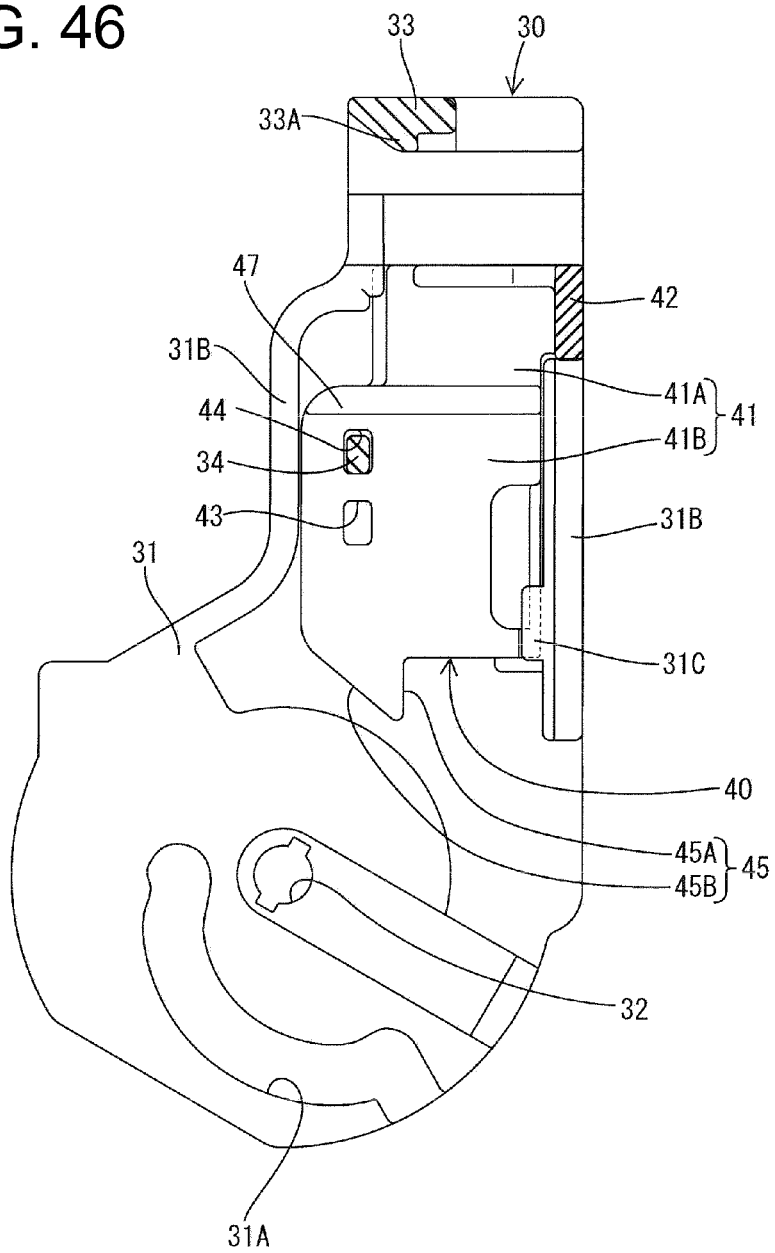
FIG. 46 is a side view showing the stopper at the final position.

The front edge of the narrow portion 41A is covered at least partly by the front locking projecting edge 31B to prevent the slide plate 41 from being separated inwardly of the cam plate 31. At the initial position, the front locking projecting edge 31B covers substantially all of the front edge of the narrow portion 41A, as shown in FIG. 45. Further, at the final position, the front locking projecting edge 31B covers only an upper end part of the front edge of the narrower portion 41A, as shown in FIG. 46. On the other hand, the rear locking projecting edge 31B does not cover the rear edge of the narrow portion 41A at either the initial position or the final position, but a flange 31C on the rear locking projecting edge 31B covers the rear edge of the wide portion 41B at the final position. This also prevents separation of the slide plate 41 inward of the cam plate 31.

Two holding projections 34, 34 project respectively from the facing surfaces of the cam plates 31, 31. On the other hand, the wider portion 41B of the slide plate 41 is provided with a first holding hole 43 that engages the holding projection 34 at the initial position. A second holding hole 44 is provided above the first holding hole 43 and engages the holding projection 34 at the final position. The first and second holding holes 43, 44 are provided side by side in a vertical sliding direction of the slide plate 41. As just described, the slide plate 41 is to be fit between the front and rear locking projecting edges 31B, 31B and the holding holes 43, 44 are to be engaged with the holding projection 34 so that the slide plate 41 is prevented from being inclined at the initial position or the final position.

Two guide projections 46, 46 are provided on a surface of the slide plate 41 facing the cam plate 31, as shown in FIG. 1. The guide projections 46, 46 are arranged at substantially diagonal positions of the slide plate 41. On the other hand, two guide holes 35, 35 are provided at positions of the cam plate 31 corresponding to the guide projections 46, 46. The guide holes 35, 35 are long and extend in the sliding direction of the slide plate 41. The guide projections 46, 46 are guided by the guide holes 35, 35. Thus, the slide plate 41 can be slid smoothly without inclination when the slide plate 41 is slid between the partial locking position and the full locking position.

A substantially pointed catch 45 is formed on the lower edge of the wide portion 41B. The catch 45 has a contact surface 45A extending substantially vertically and an engaging surface 45B extending substantially obliquely forward from the lower edge of this contact surface 45A. The catch 45 is located below the holding holes 43, 43 and at a position close to the front locking projecting edge 31B. In this way, even if the contact surface 45A of the catch 45 receives a strong force from behind, this force can be received reliably received by the front locking projecting edge 31B.

Figure 18:
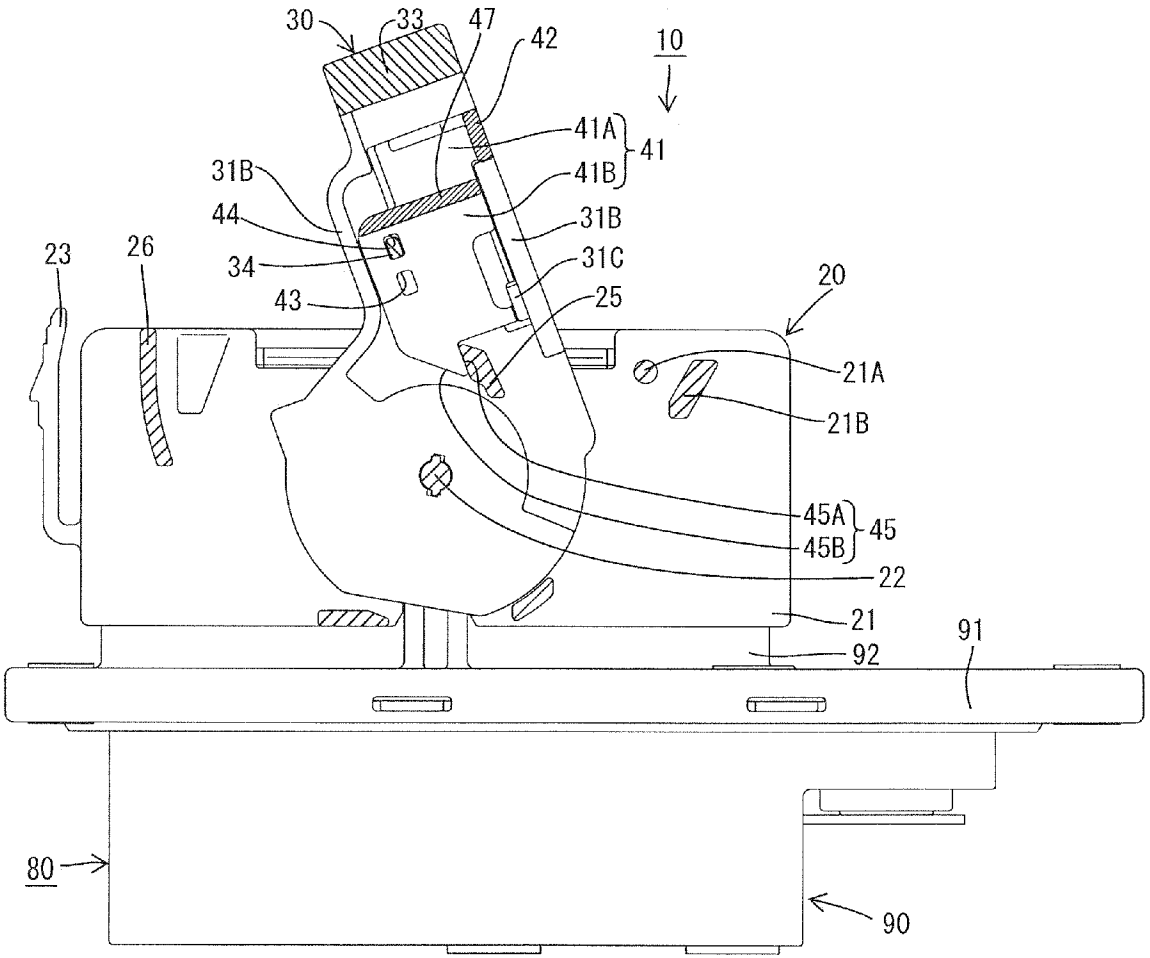
FIG. 18 is a section corresponding to FIG. 9, showing a state where the stopper is in contact with a restricting wall to stop the rotation of the lever.

In the separating process of the cover 20, the contact surface 45A of the catch 45 contacts the restricting wall 25 on the outer peripheral wall 21 of the cover 20, as shown in FIG. 18, to stop the rotation of the lever 30. The restricting wall 25 has a substantially parallelogram shape and has an undercut restricting surface facing the supporting pin 22. The stopper 40 is pulled toward the supporting pins 22 if there is an attempt to rotate the lever 30 to the partial locking position 1P with the contact surface 45A of the catch 45 engaged with this restricting surface. Accordingly, rotation of the lever 30 is stopped with the stopper 40 at the final position.

Figure 19:
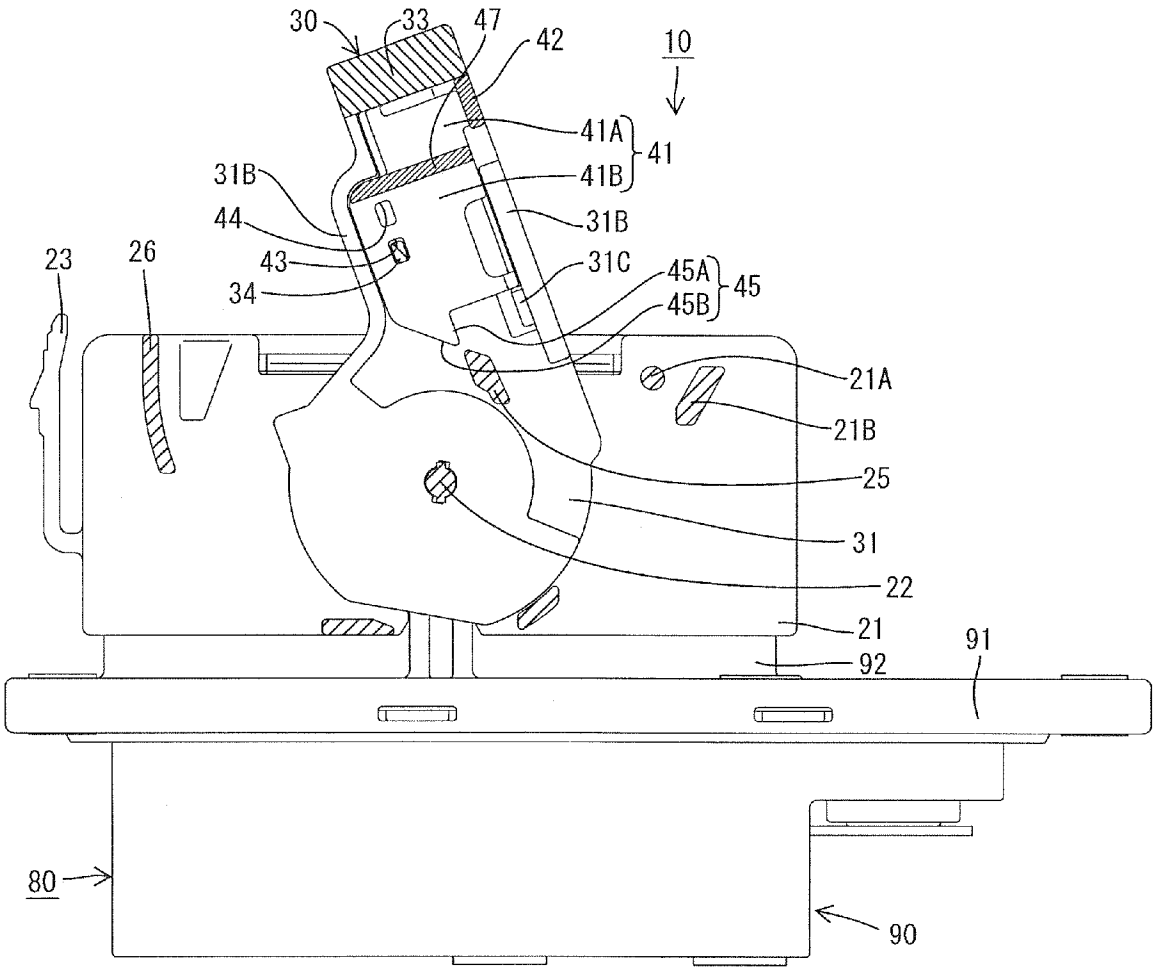
FIG. 19 is a section corresponding to FIG. 10, showing a state reached by moving the stopper to the initial position.

The stopper 40 needs to be returned from the final position to the initial position to resume the rotation of the lever 30. Displacement of the stopper 40 to the initial position disposes the contact surface 45A of the catch 45 at a position for movement over the restricting wall 25, as shown in FIG. 19. The lever 30 then is rotated so that the contact surface 45A moves over the restricting wall 25 and the lever 30 reaches the partial locking position 1P. A delay time until the rotation of the lever 30 is resumed after being stopped is longer than a time until the power supply circuit is cut off by the relay after the detection terminal 60 is set in the OFF-state.

At least one interference portion 47 projects in the thickness direction between the narrow portion 41A and the wide portion 41B of the slide plate 41. The interference portion 47 is an elongated projection that extends substantially straight. On the other hand, at least one engaging wall 26 is provided on the outer peripheral wall 21 of the cover 20 and is engageable with the interference portion 47. The engaging wall 26 has an arcuate or bent shape to approach the supporting pin 22 as it extends down from the upper end of the outer peripheral wall 21.

Figure 14:
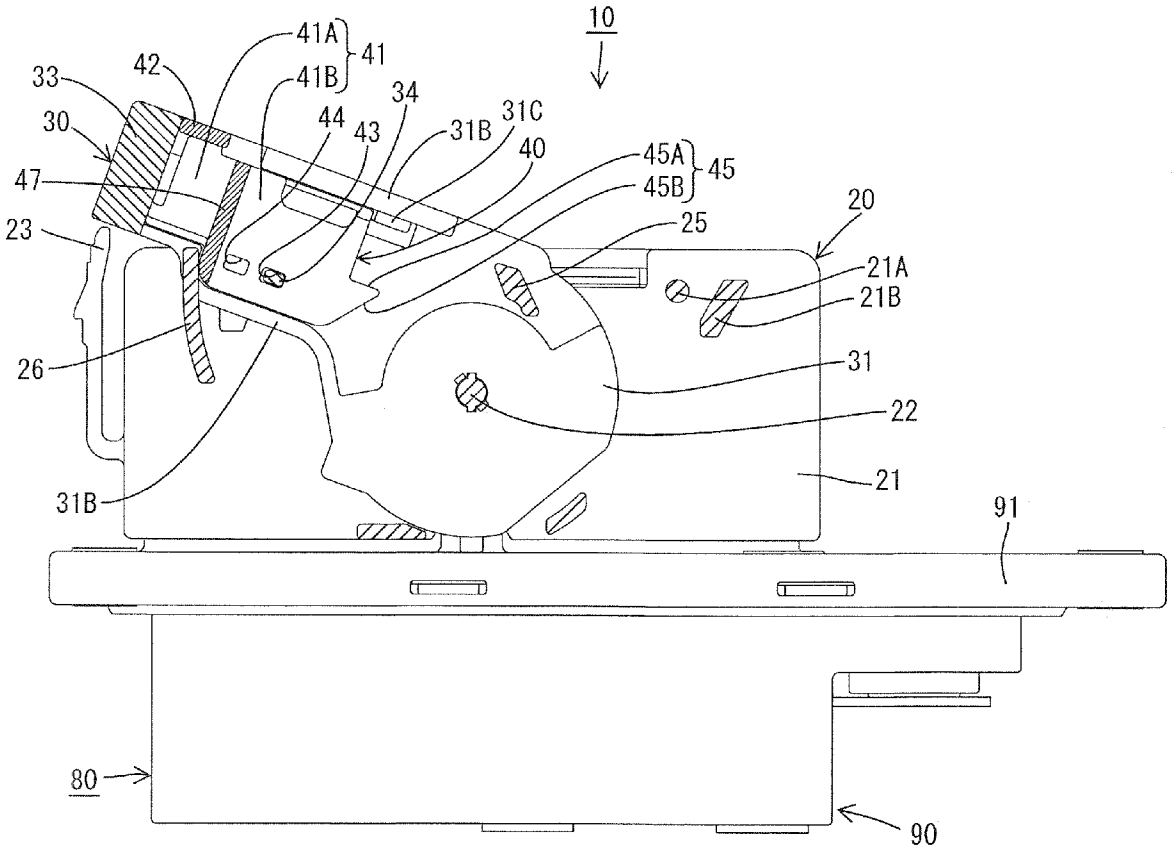
FIG. 14 is a section corresponding to FIG. 5, showing a state where the stopper starts engaging with an engaging wall.

The interference portions 47 of the stopper 40 are at the initial position in the connecting process of the cover 20 and engage the inner peripheral surfaces of the engaging walls 26, as shown in FIG. 14. The engagement of the interference portions 47 and the engaging wall portions 26 pushes the stopper 40 toward the supporting pins 22 as the lever 30 is rotated farther. The stopper 40 reaches the final position when the lever 30 reaches the full locking position 2P.

Figure 15:
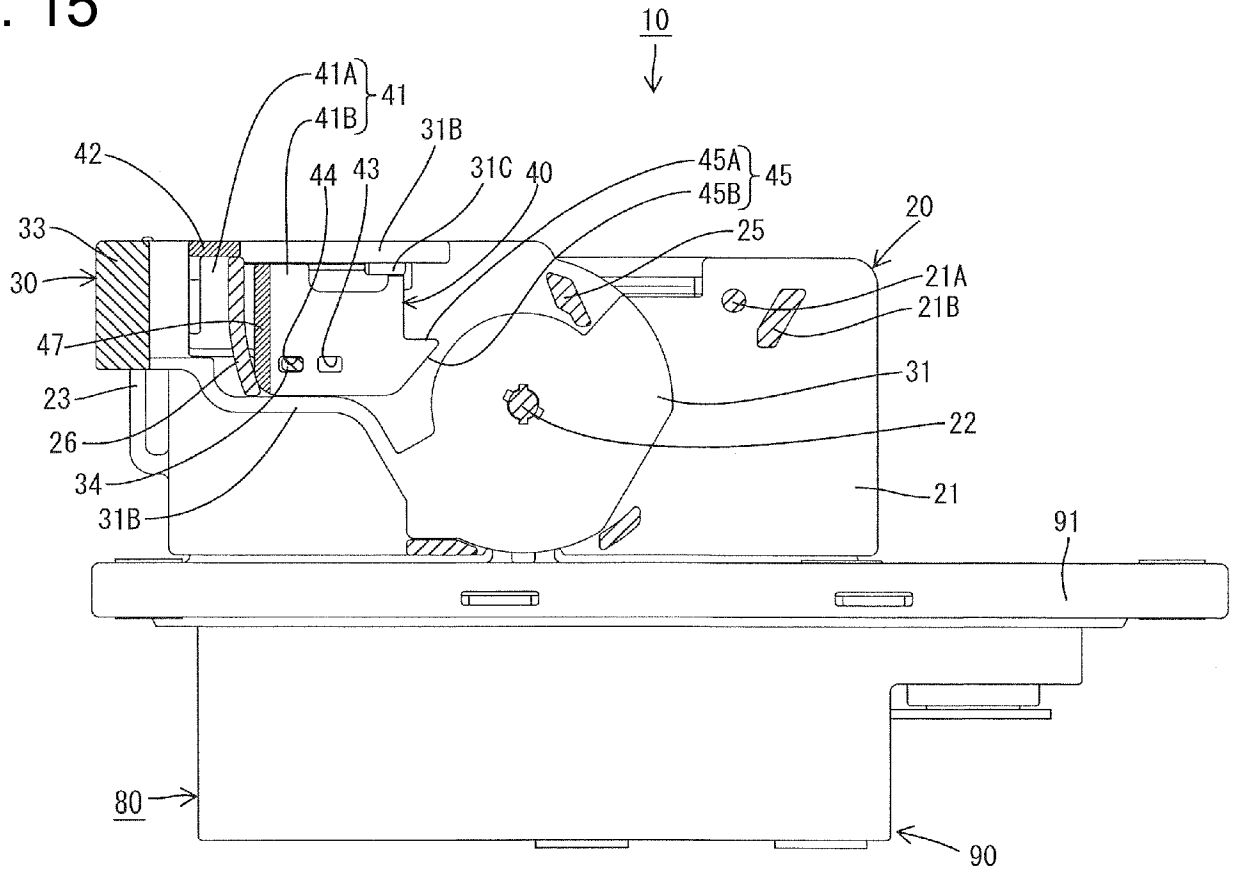
FIG. 15 is a section corresponding to FIG. 6, showing a state reached by moving the stopper to the final position.
Figure 29:
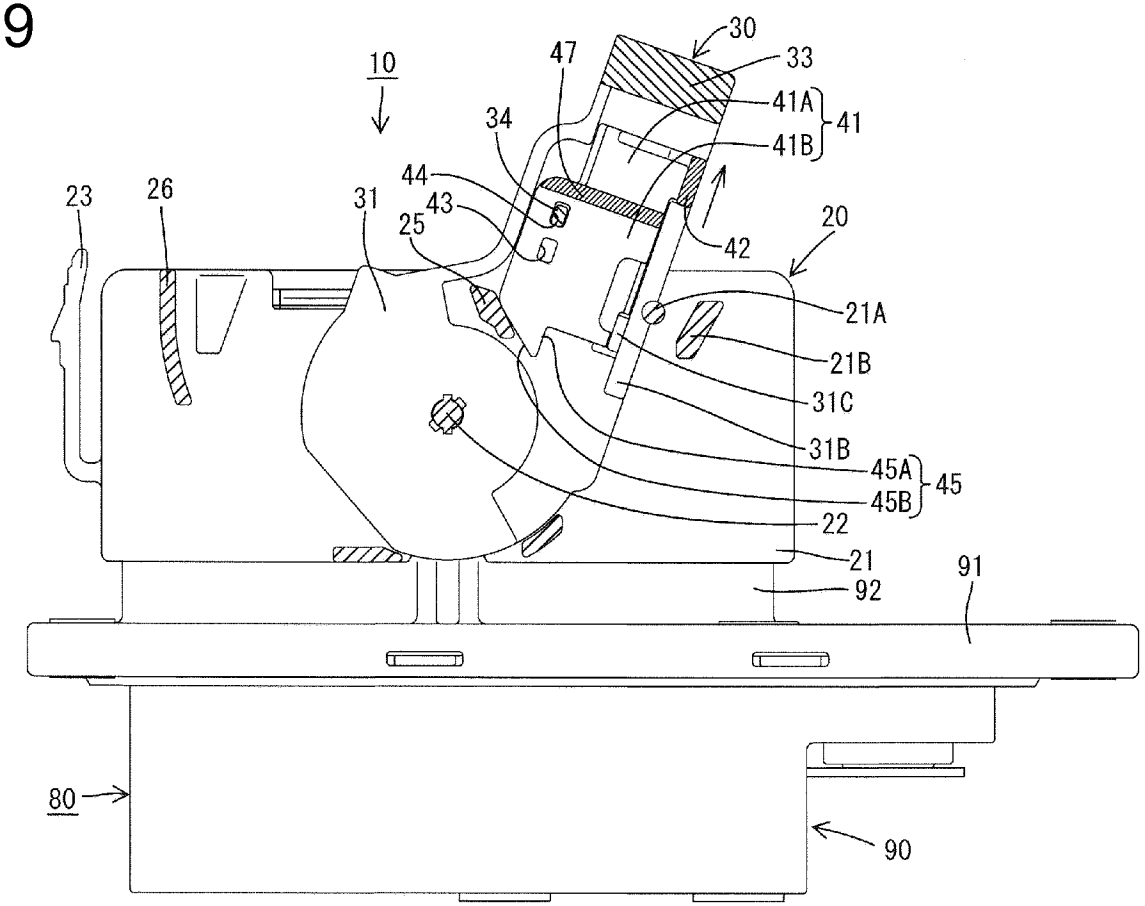
FIG. 29 is a section showing a state where the stopper is engaged with the restricting wall and returns to the initial position.

A mechanism is provided to return the stopper 40 from the final position to the initial position if the lever 30 is rotated to the full locking position 2P when the lever 30 is at the partial locking position 1P and the stopper 40 is at the final position. A surface of the restricting wall 25 substantially opposite to the supporting pin 22 has a move-on surface on which the engaging surface 45B of the catch 45 can move. The stopper 40 is moved forcibly from the final position to the initial position when the engaging surfaces 45B of the catches 45 engage the move-on surfaces of the restricting walls 25, as shown in FIG. 29. The interference portions 47 subsequently engage the engaging walls 26 as shown in FIG. 14, when the lever 30 is rotated. The stopper 40 is at the final position, as shown in FIG. 15 when the lever 30 reaches the full locking position 2P.

The lever 30 initially is set in a state where the right locking projecting edges 31B are arranged between the partial locking projections 21A and partial engaging walls 21B, as shown in FIG. 11. Thus, the lever 30 is held at the partial locking position 1P and the rotation to the full locking position 2P is prevented. However, the partial locking projections 21A have a substantially semispherical shape and are engaged only with the locking projecting edges 31B in a semi-locked state. Thus, the locking projecting edges 31B move over the partial locking projections 21A to permit the rotation of the lever 30 if a specified force is applied to the lever 30.

Figure 2:
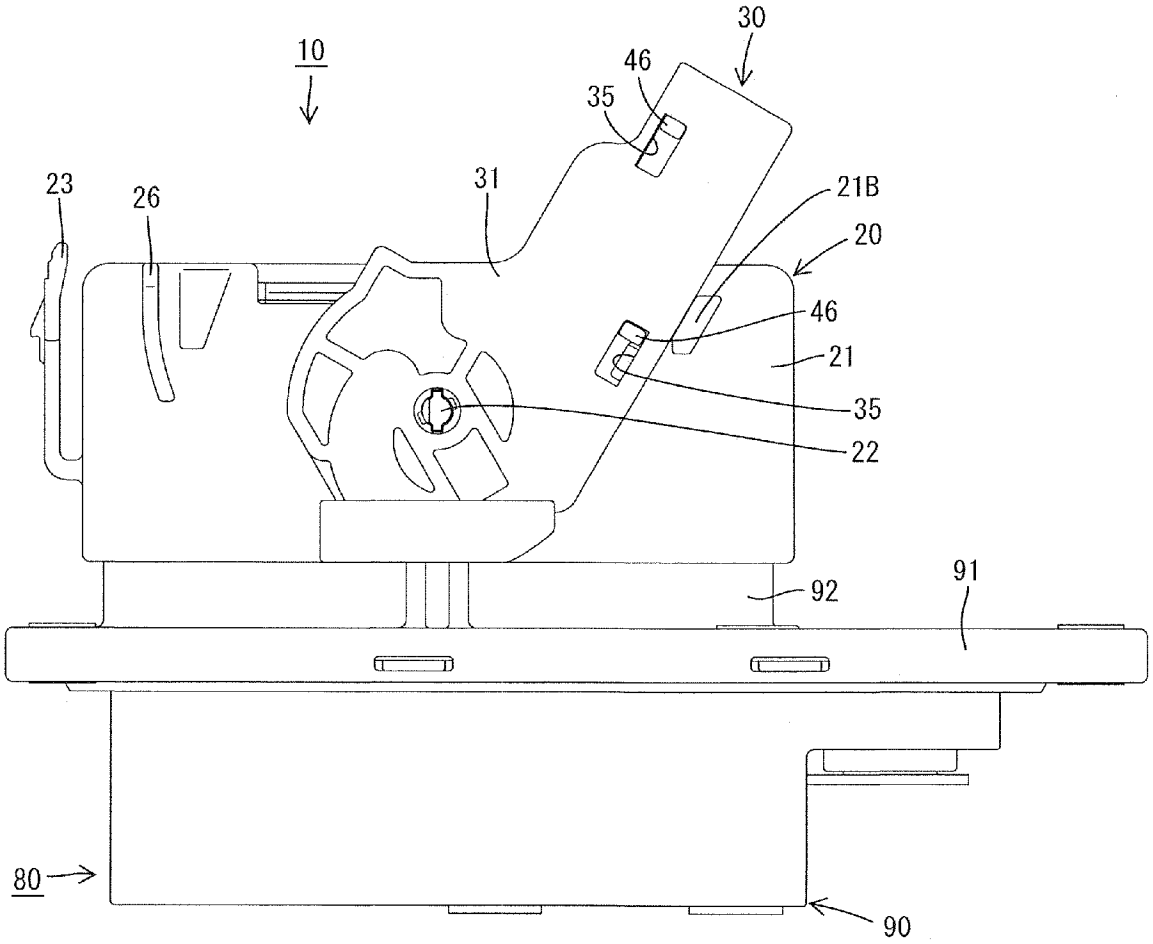
FIG. 2 is a front view showing the cover fit lightly to the housing.
Figure 20:
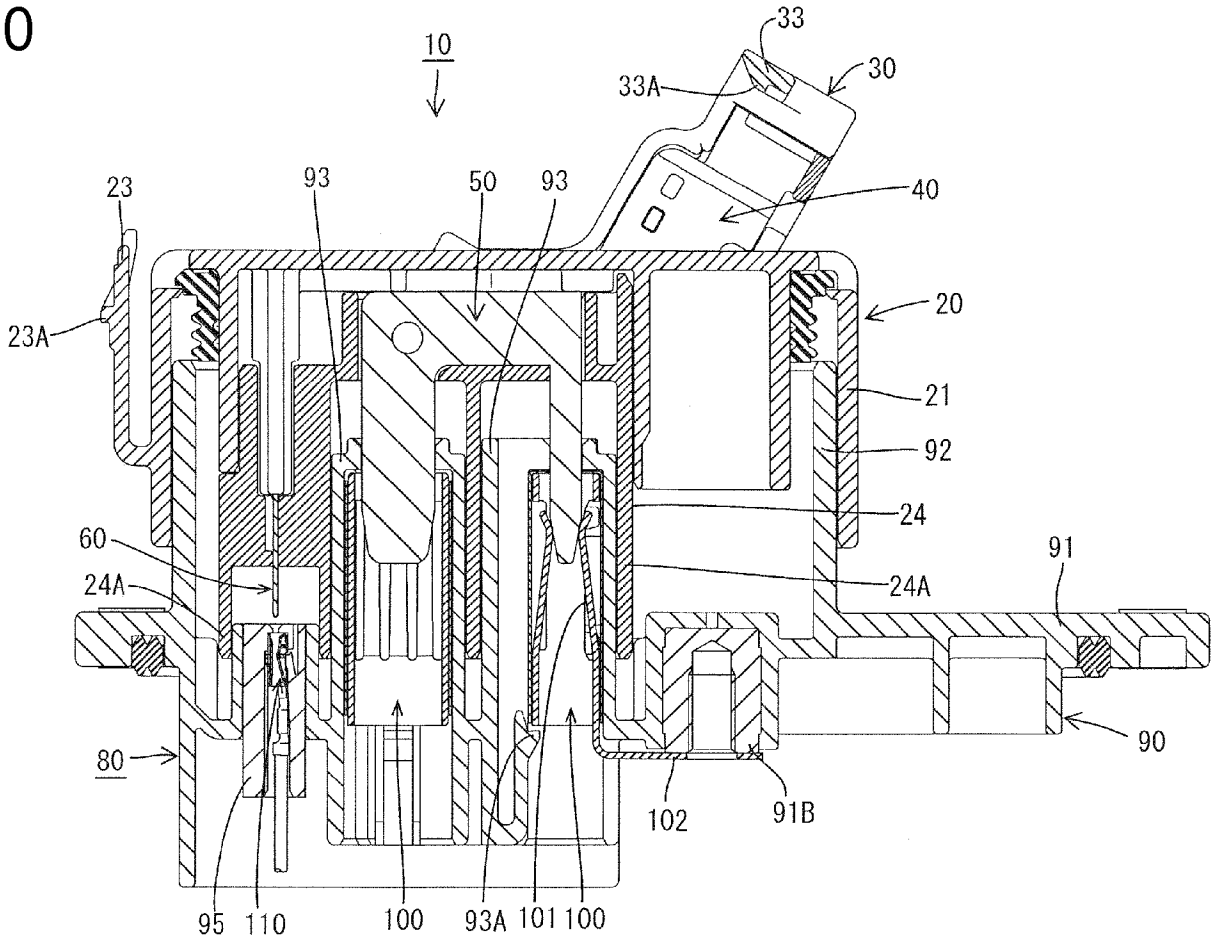
FIG. 20 is a section corresponding to FIG. 2, showing a cover-side power supply terminal starting to be connected with a waiting-side power supply terminal.

If it is tried to connect the cover-side connector 10 to the waiting-side connector 80 in the state of FIG. 1, the both 10, 80 are lightly fitted as shown in FIG. 2. As they are connected, the one or more heavy current terminals 50 are fitted into the respective one or more intermediate terminals 100 to be electrically conductively connected as shown in FIG. 20. On the other hand, the at least one detection terminal 60 is not yet connected to the respective relay-side terminal 110 and remains in the OFF-state. Thus, the power supply circuit is in a cut-off state. Note that the stopper 40 particularly is held or positioned at the initial position since the one or more holding projections 34 are fitted in the respective one or more first holding holes 43 as shown in FIG. 11.

Figure 3:
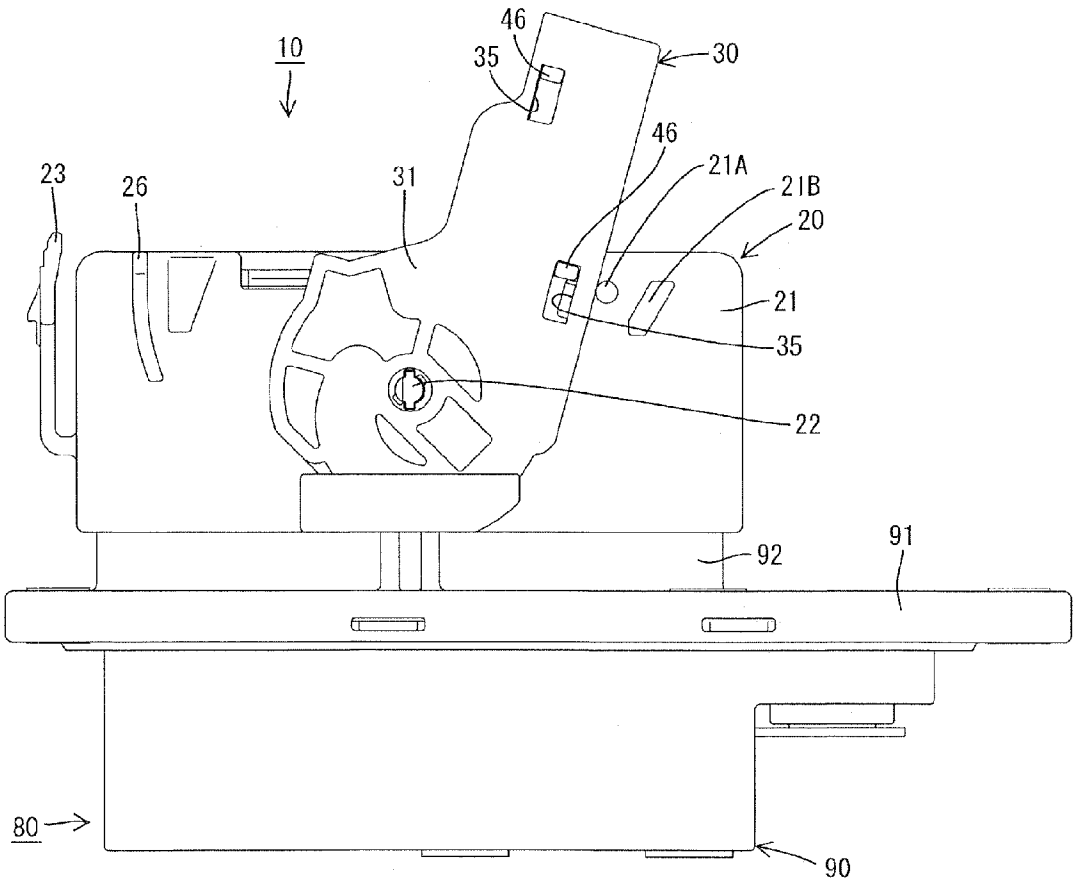
FIG. 3 is a front view showing partial locking of the lever released.
Figure 4:
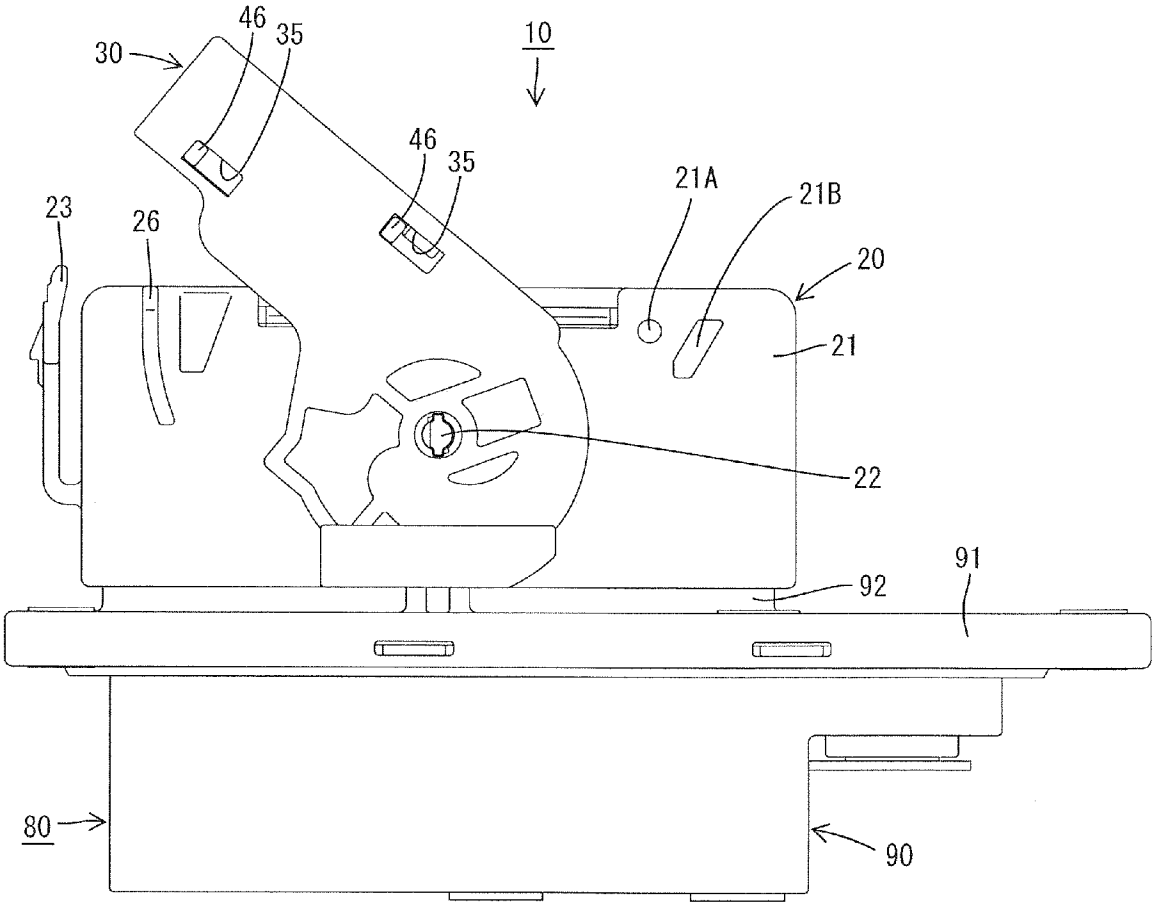
FIG. 4 is a front view showing a state immediately before a detection terminal is set in an ON-state.
Figure 12:
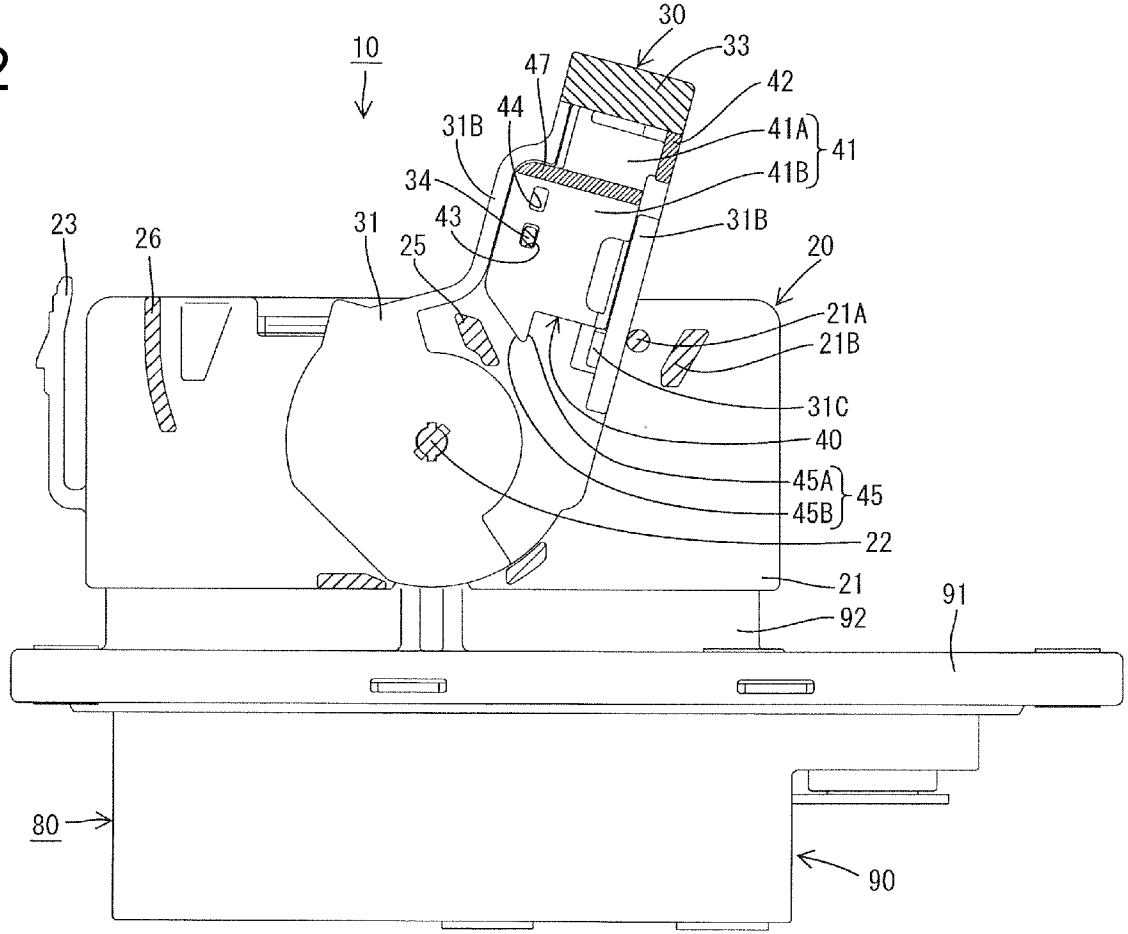
FIG. 12 is a section corresponding to FIG. 3.
Figure 21:
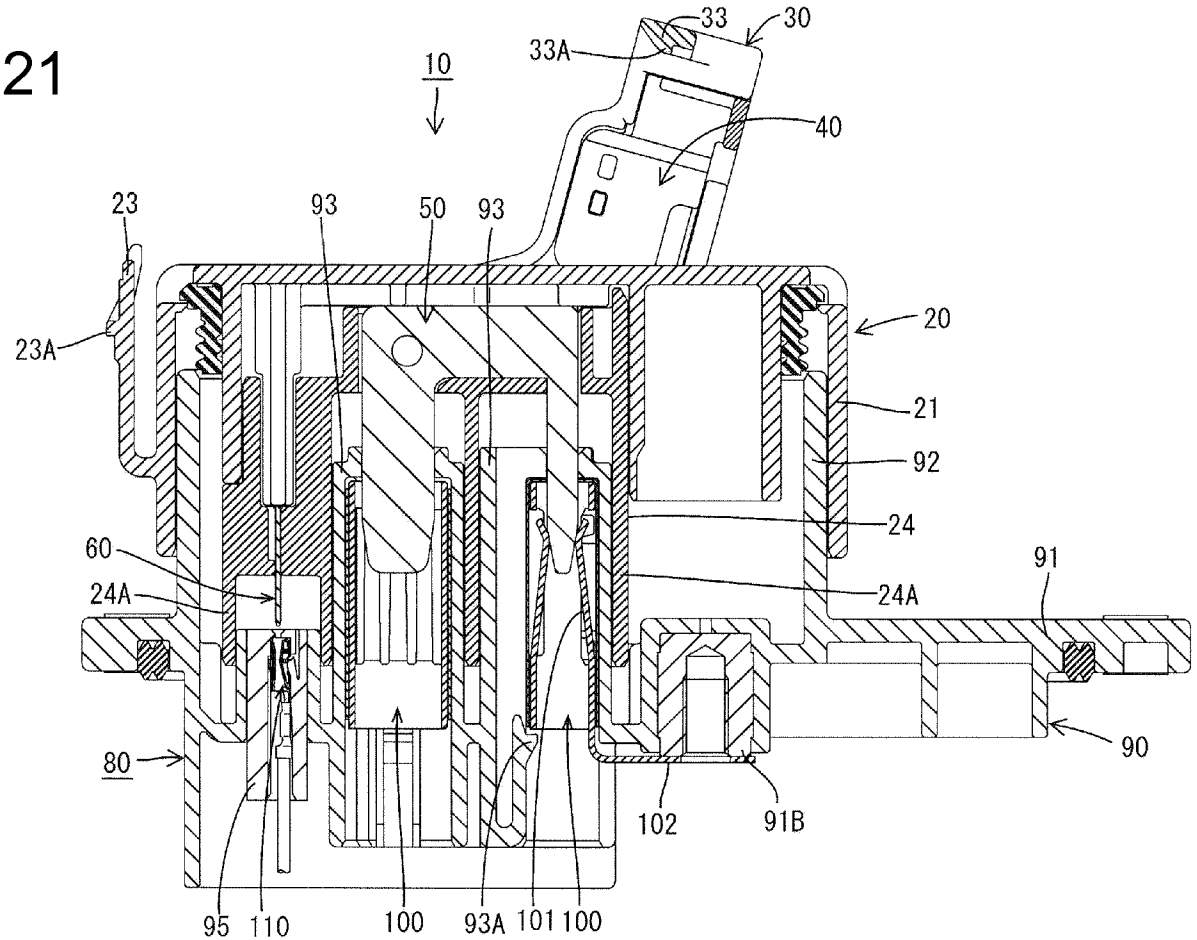
FIG. 21 is a section corresponding to FIG. 3.

The shown right locking projecting edges 31 B move over the partial locking projections 21A when the lever 30 is rotated slightly toward the full locking position 2P to permit rotation of the lever 30. Thus, the lever 30 starts rotating, as shown in FIGS. 3 and 12 and connection of the cover-side connector 10 and the waiting-side connector 80 is started. Note that the stopper 40 remains held at the initial position, as shown in FIG. 12, the heavy current terminals 50 are fit in the respective intermediate terminals 100 to be connected electrically conductively, as shown in FIG. 21, and the detection terminal 60 remains in the OFF-state, as shown in FIG. 21.

When the lever 30 is at the partial locking position 1P, the stopper 40 may be erroneously held at the final position although it is supposed to be at the initial position. In such a case, it is sufficiently possible to rotate the lever 30 toward the final position 2P without it being noticed that the stopper 40 is held at the final position. Even in such a case, as shown in FIG. 29, the engaging surfaces 45B of the catches 45 move onto the restricting walls 25 to be engaged therewith, whereby the stopper 40 can be forcibly returned from the final position to the initial position.

Figure 13:
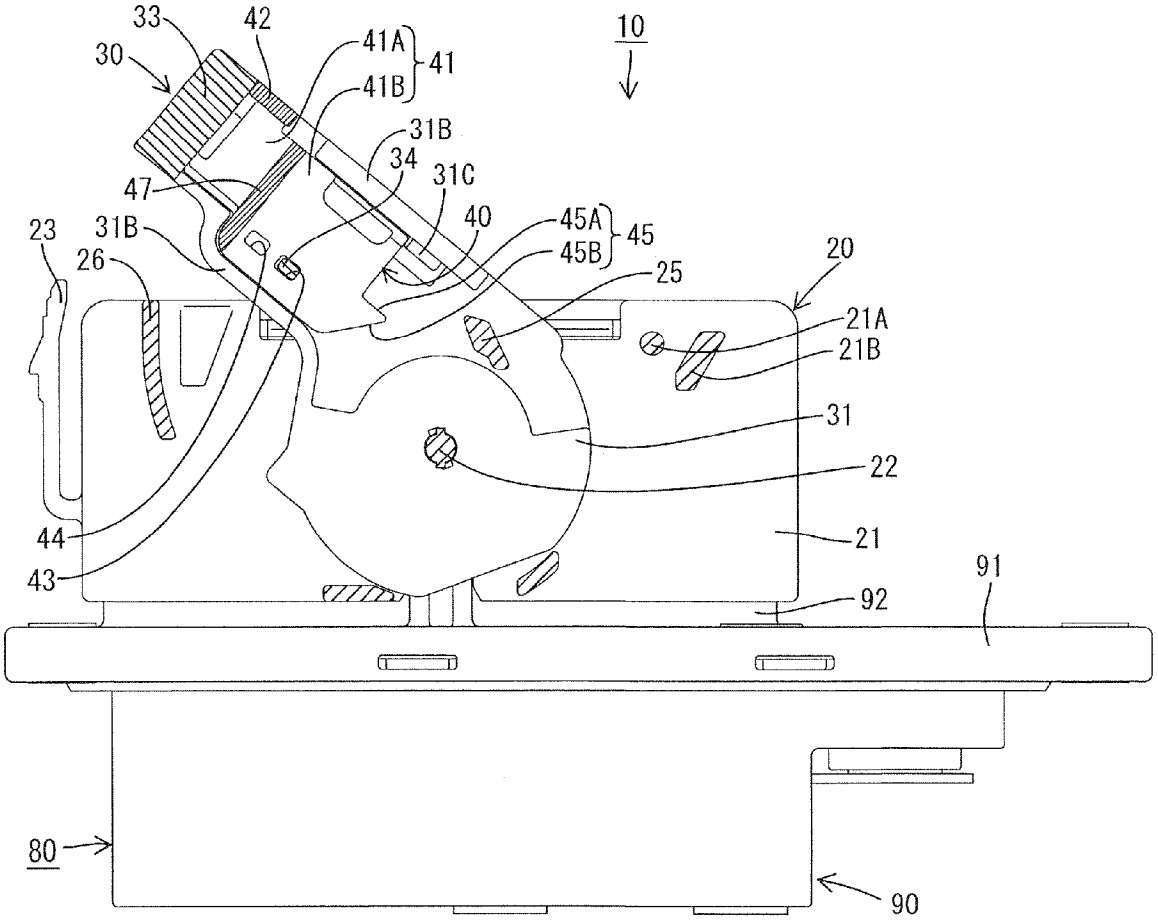
FIG. 13 is a section corresponding to FIG. 4.
Figure 22:
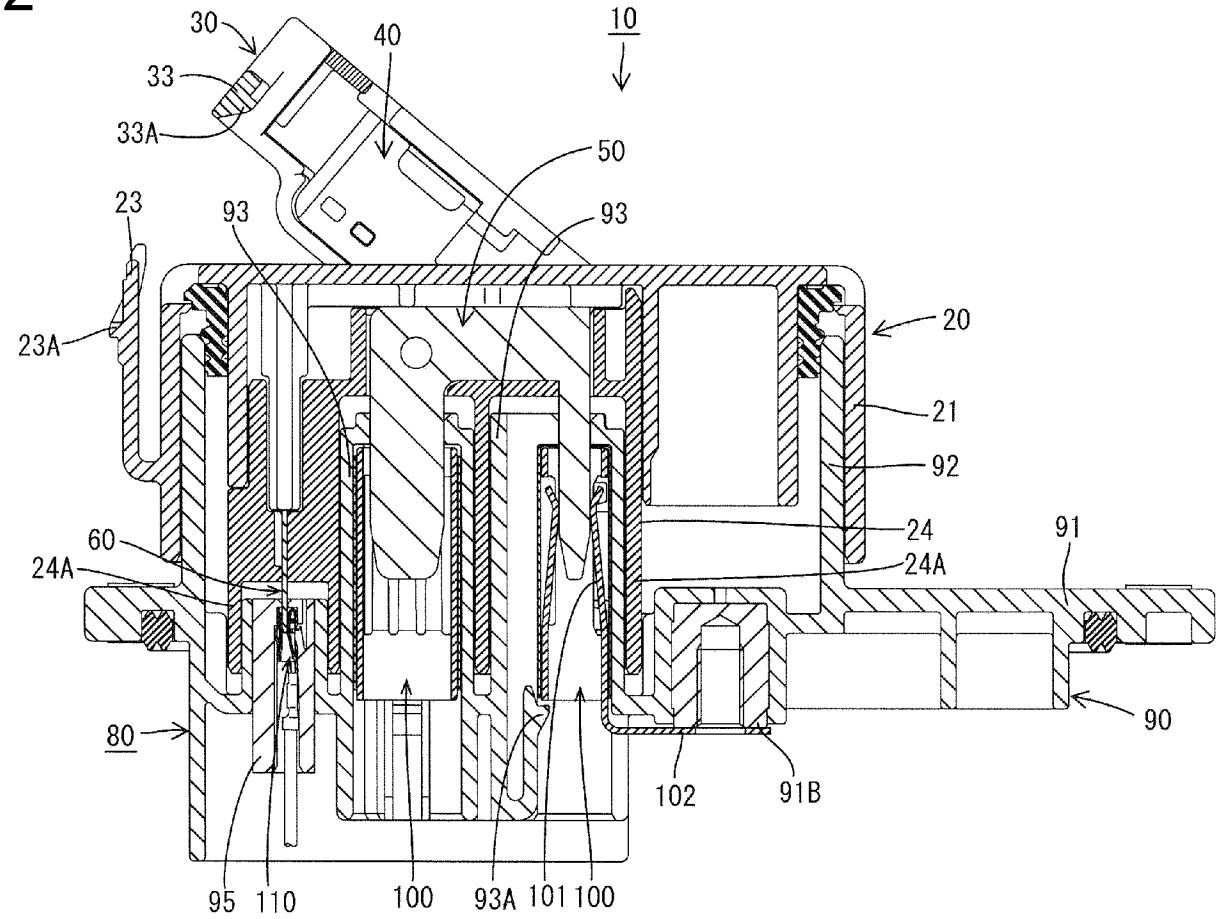
FIG. 22 is a section corresponding to FIG. 4, showing the state where the cover-side power supply terminal starts being connected with the waiting-side power supply terminal (the detection terminal is in the ON-state).

The lever 30 is rotated farther. In an intermediate state of rotation shown in FIG. 4, the cover-side connector 10 and the waiting-side connector 80 are being connected, the stopper 40 is held at the initial position as shown in FIG. 13, and the heavy current terminals 50 are fit in the intermediate terminals 100 as shown in FIG. 22. On the other hand, the detection terminal 60 is fit into the relay-side terminal 110 to be connected electrically conductively. This causes an electrical signal to be transmitted from the relay-side terminal to the relay and the relay is switched to a state capable of energizing the power supply circuit based on this electrical signal.

Figure 5:
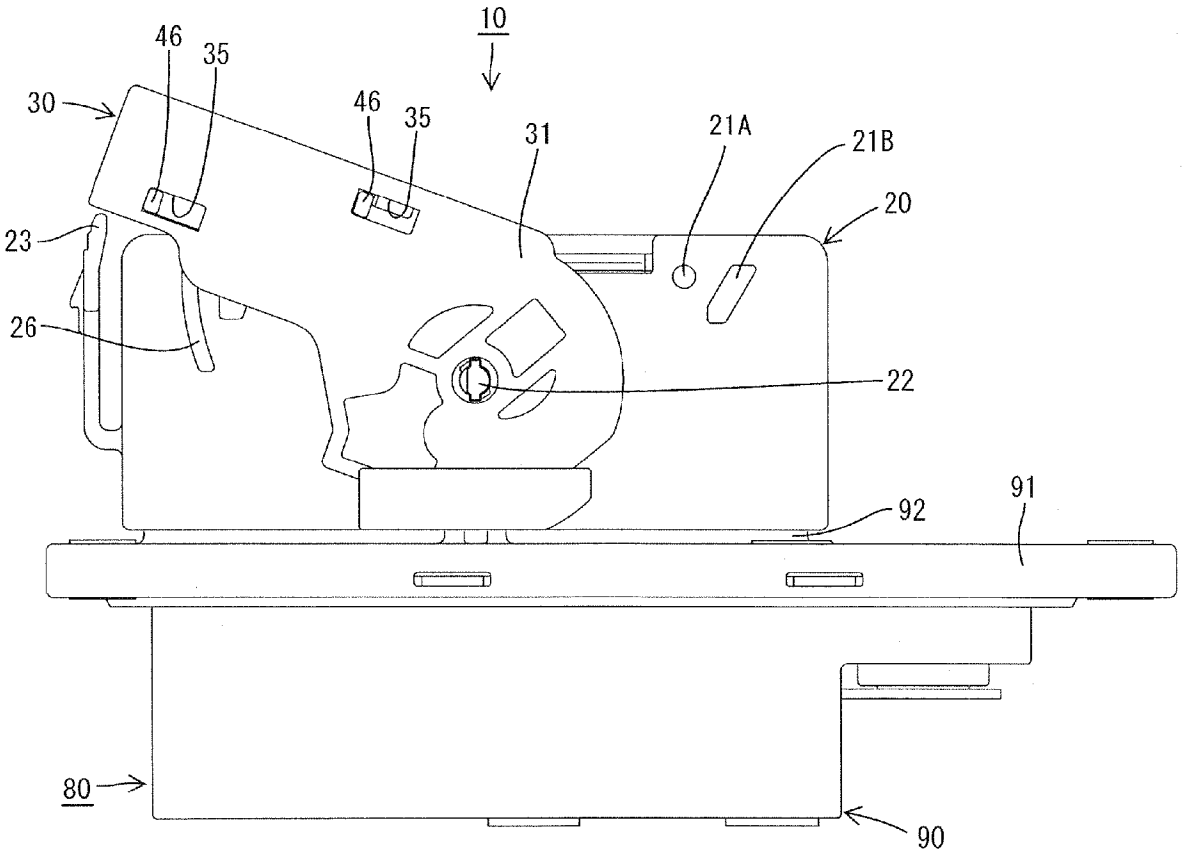
FIG. 5 is a front view showing a state immediately before full locking by a lever lock portion is started.
Figure 23:
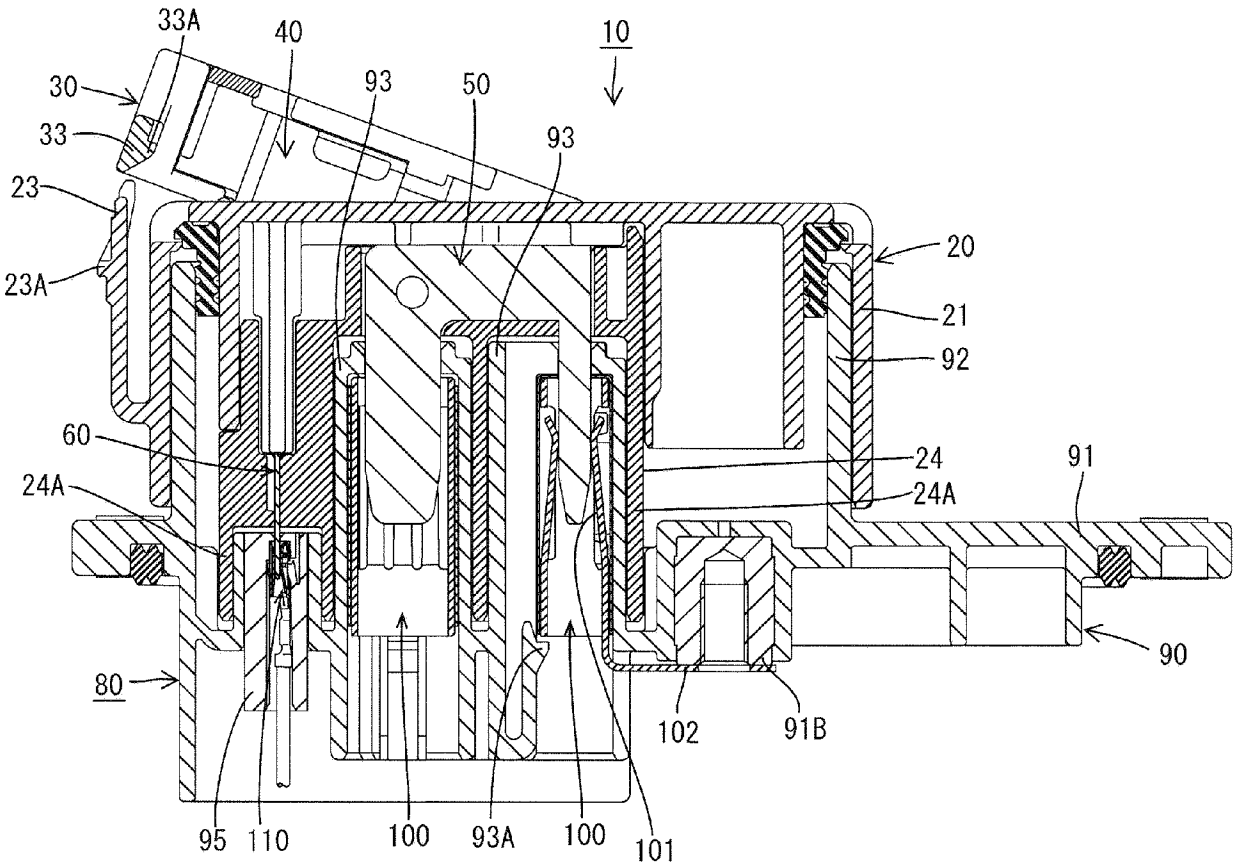
FIG. 23 is a section corresponding to FIG. 5, showing a state immediately before full locking by the lever lock starts.

When the lever 30 is rotated farther, the operating portion 33 of the lever 30 contacts the lever lock portion 23 of the cover 20, as shown in FIG. 5, to start full locking of the cover 30. Further, the cover-side connector 10 and the waiting-side connector 80 are substantially completely connected as shown in FIG. 23. Further, the heavy current terminals 50 are fit in the intermediate terminals 100 and the detection terminal 60 is fit in the relay-side terminal 110. On the other hand, the interference portions 47 of the stopper 40 start engaging with the engaging walls 26 of the cover 20, as shown in FIG. 14.

When the lever 30 is rotated farther, the cover-side connector 10 is connected properly to the waiting-side connector 80 and arranged at a connection position shown in FIG. 6. Further, the heavy current terminals 50 are fit in the intermediate terminals 100 and the detection terminal 60 is fit in the relay-side terminal 110. On the other hand, the interference portions 47 of the stopper 40 are engaged with the engaging walls 26 of the cover 20 and the stopper 40 is moved to the final position shown in FIG. 15. At this time, the full locking projection 23A of the lever lock portion 23 is engaged with the engaging projection 33A of the operating portion 33 as shown in FIG. 24. Therefore the lever 30 is locked at the full locking position 2P.

Next, the separating process of the cover 20 is described with reference to FIG. 50. In a fully locked state in the separating process of the cover 20, the lever 30 is locked at the full locking position 2P by the lever lock 23 and the cover-side connector 10 and the waiting-side connector 80 are held in a connection completed state.

Figure 7:
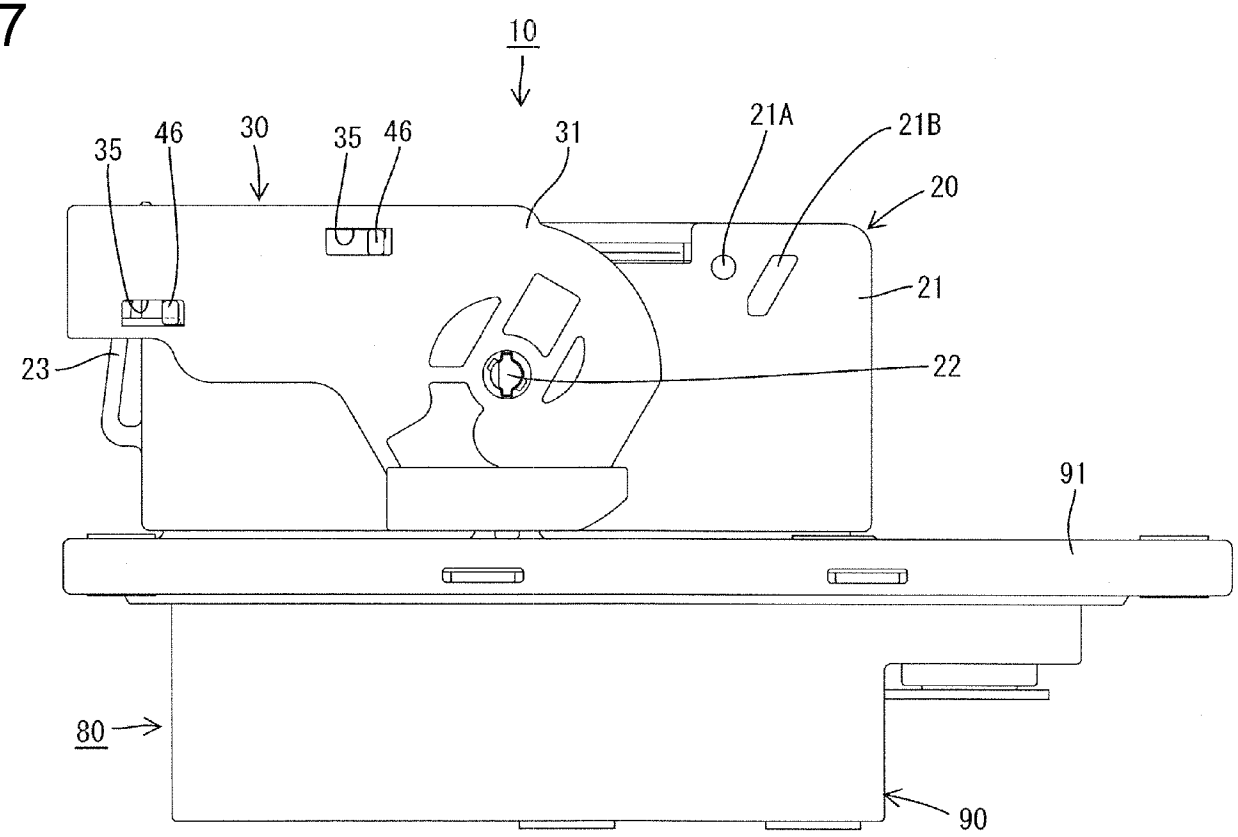
FIG. 7 is a front view showing a state where full locking by the lever lock portion is released.
Figure 16:
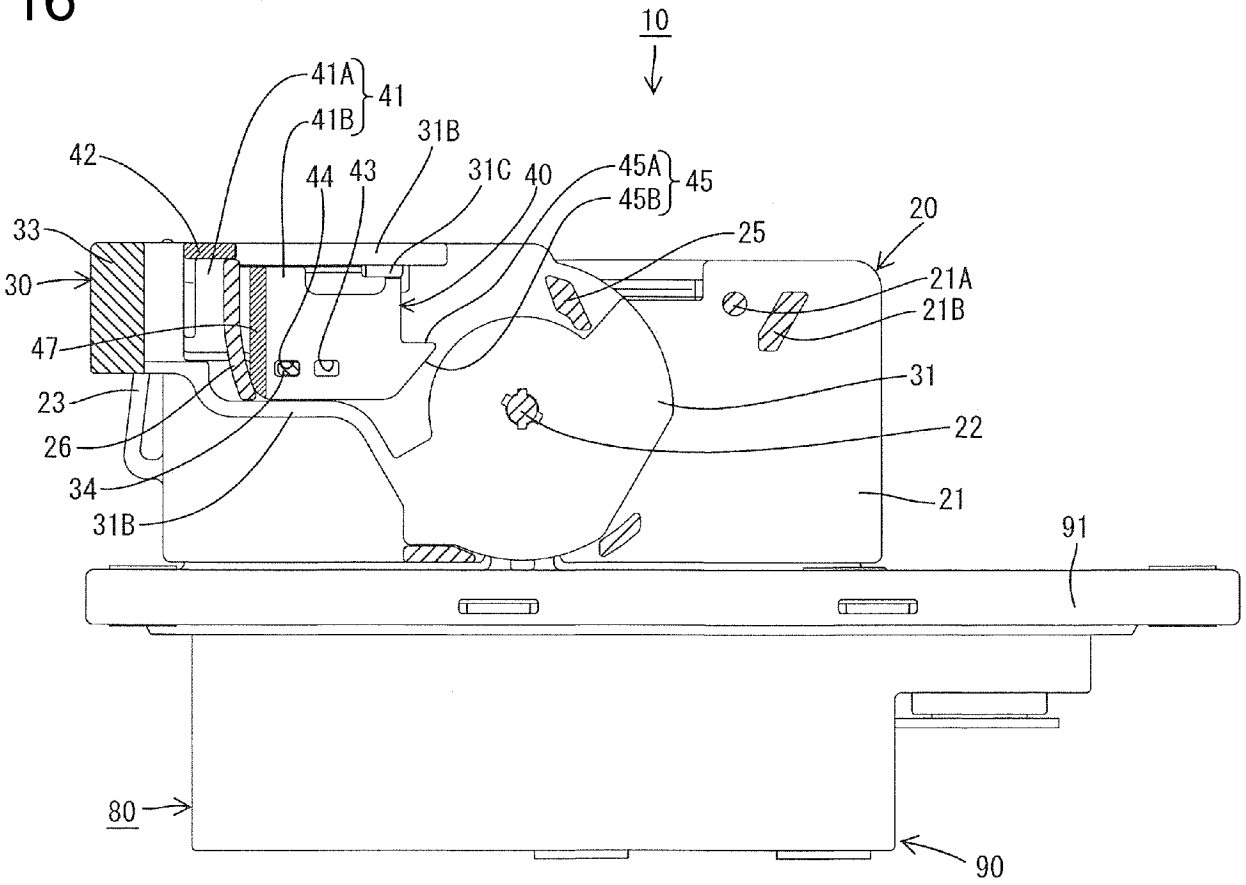
FIG. 16 is a section corresponding to FIG. 7.
Figure 25:
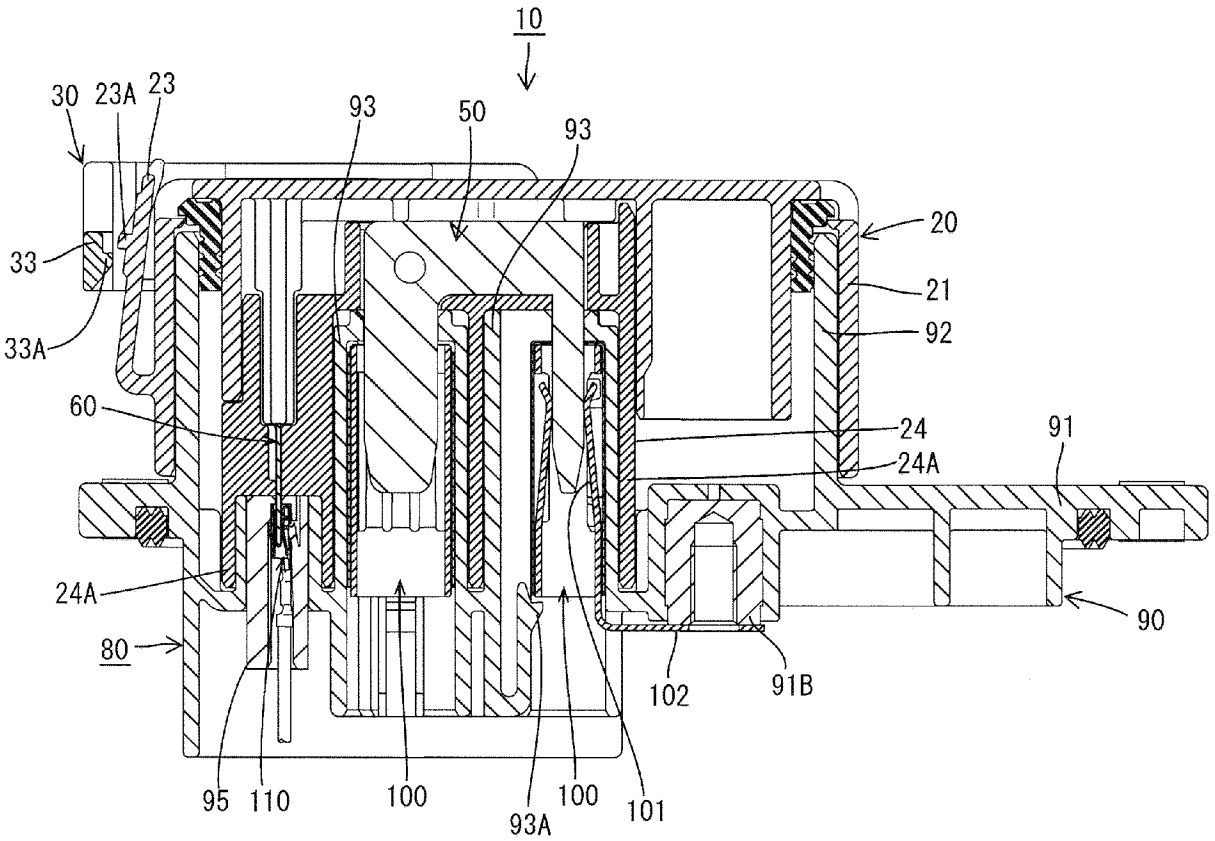
FIG. 25 is a section corresponding to FIG. 7, showing the state where full locking by the lever lock is released.

As shown in FIG. 25, the full locking projection 23A and the engaging projection 33A are disengaged by resiliently deforming the lever lock 23 toward the outer peripheral wall 21 of the cover 20. In this state, as shown in FIG. 7, rotation of the lever 30 has been started and the separation of the cover-side connector 10 and the waiting-side connector 80 has been started. At this time, the heavy current terminals 50 are fit in the intermediate terminals 100 and the detection terminal 60 is fit in the relay-side terminal 110. On the other hand, the stopper 40 is at the final position as shown in FIG. 16.

Figure 8:
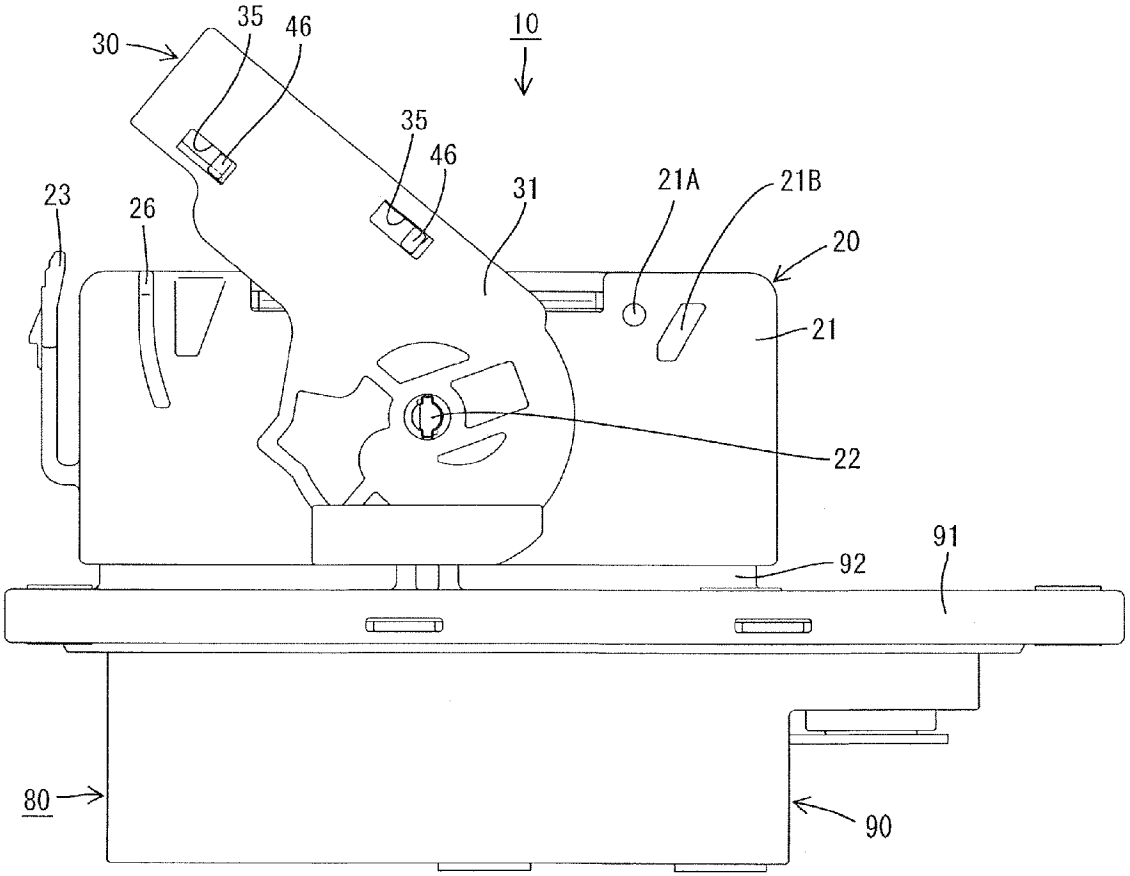
FIG. 8 is a front view showing a state immediately after the detection terminal is set in an OFF-state.
Figure 9:
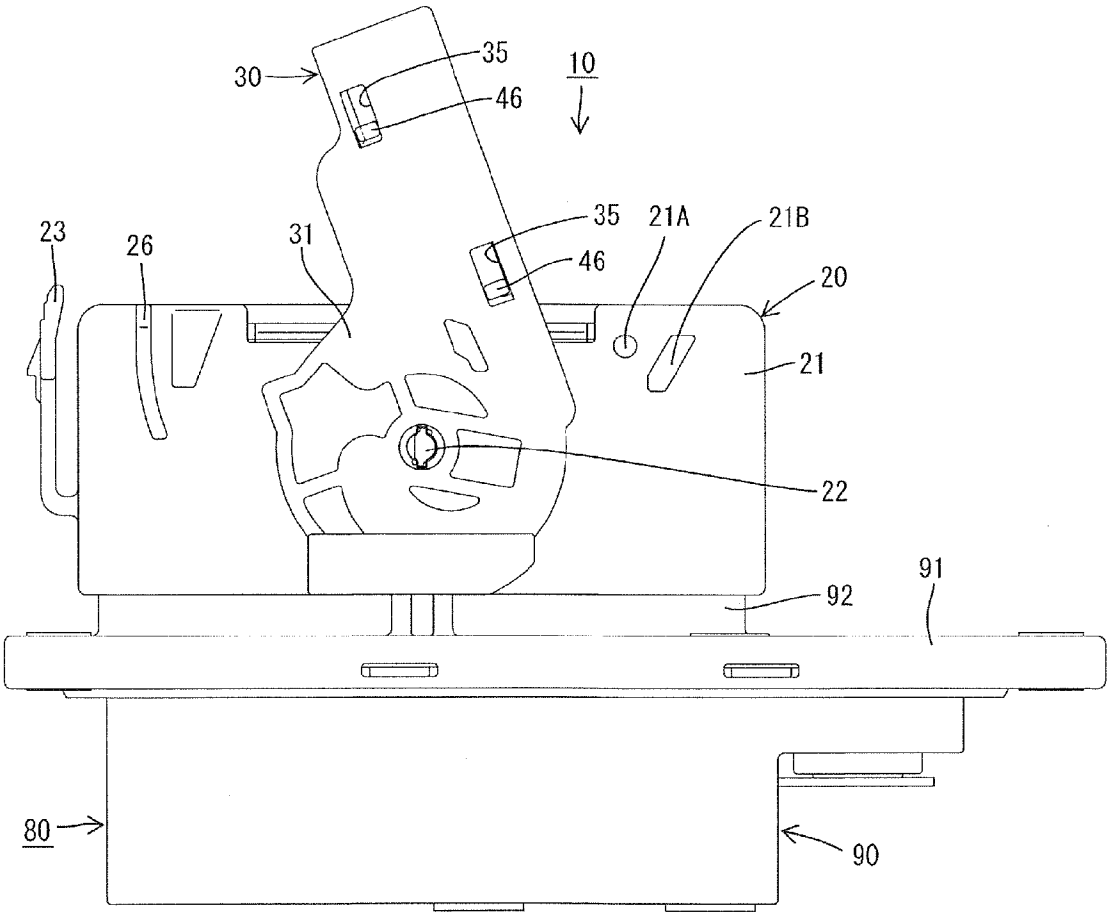
FIG. 9 is a front view showing the rotation of the lever stopped by a stopper.
Figure 10:
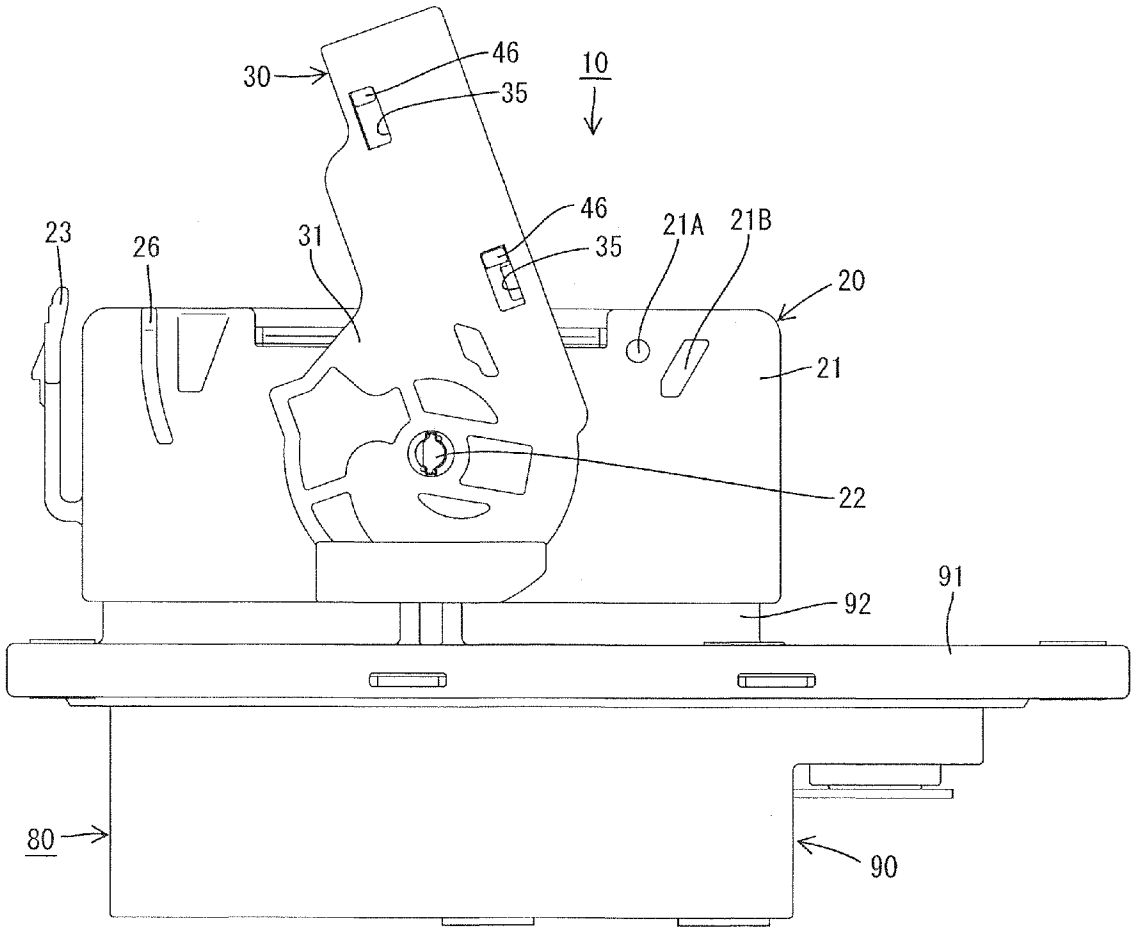
FIG. 10 is a front view showing a state attained by moving the stopper from a final position to an initial position.
Figure 17:
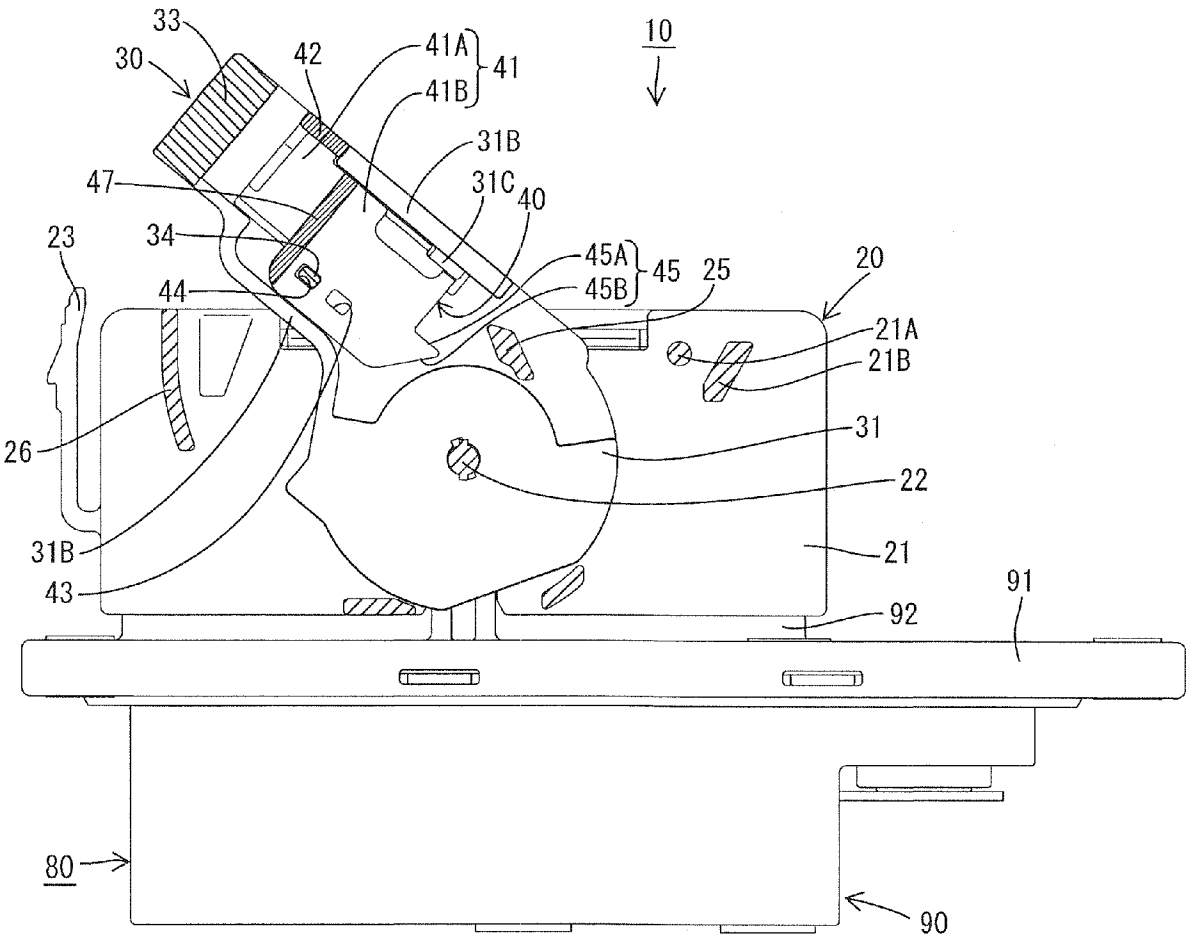
FIG. 17 is a section corresponding to FIG. 8.
Figure 26:
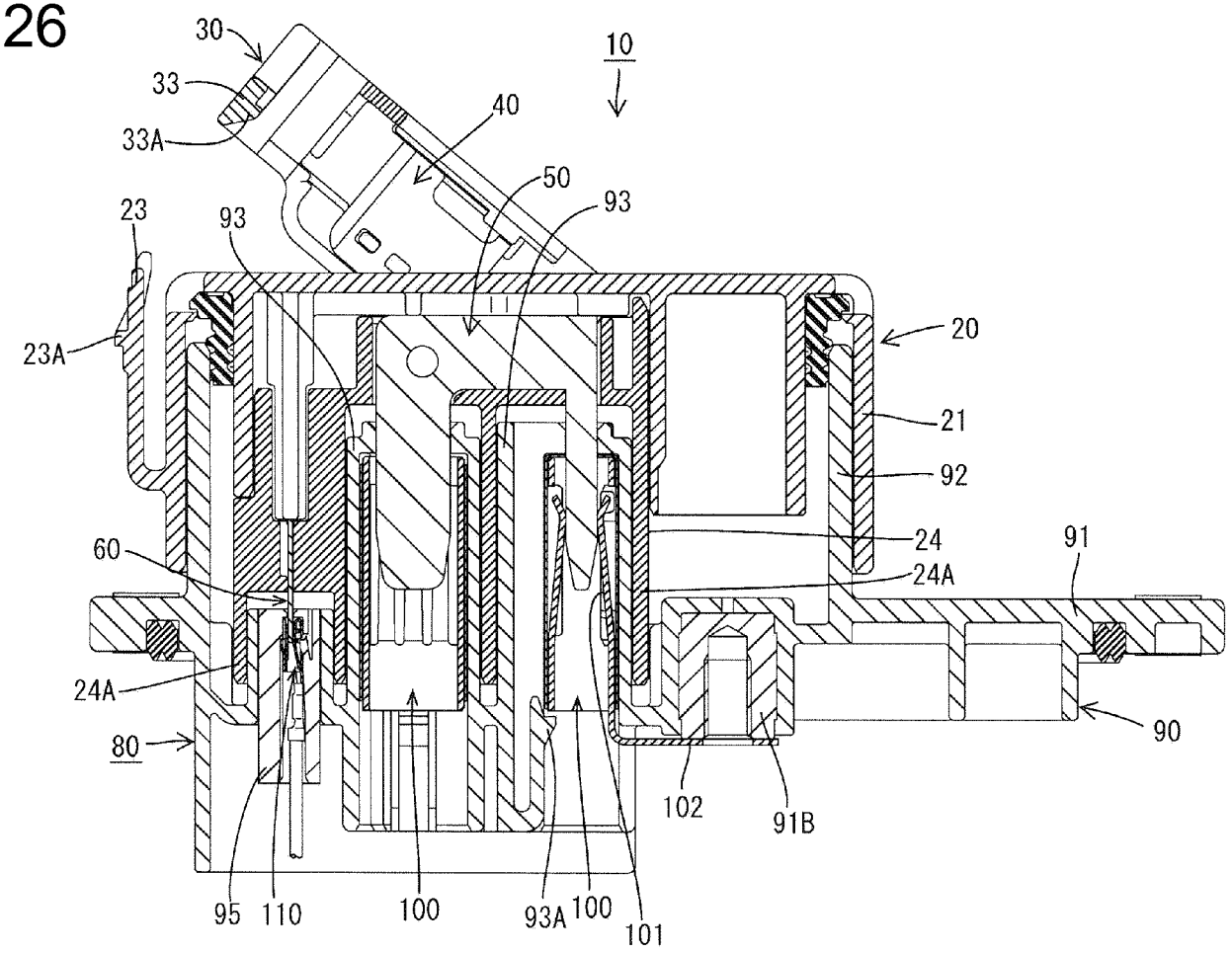
FIG. 26 is a section corresponding to FIG. 8, showing a state immediately before the detection terminal is set in the OFF-state.

In an intermediate stage of the rotation of the lever 30 toward the partial locking position shown in FIG. 8, the cover-side connector 10 and the waiting-side connector 80 are being separated, the stopper 40 is held at the final position as shown in FIG. 17 and the heavy current terminals 50 are fit in the intermediate terminals 100 as shown in FIG. 26. On the other hand, the detection terminal 60 starts being separated from the relay-side terminal 110. When the detection terminal 60 is separated from the relay-side terminal 110 and set in the OFF-state, no more electrical signal is transmitted to the relay and the relay switches the power supply circuit to the cut-off state.

Figure 27:
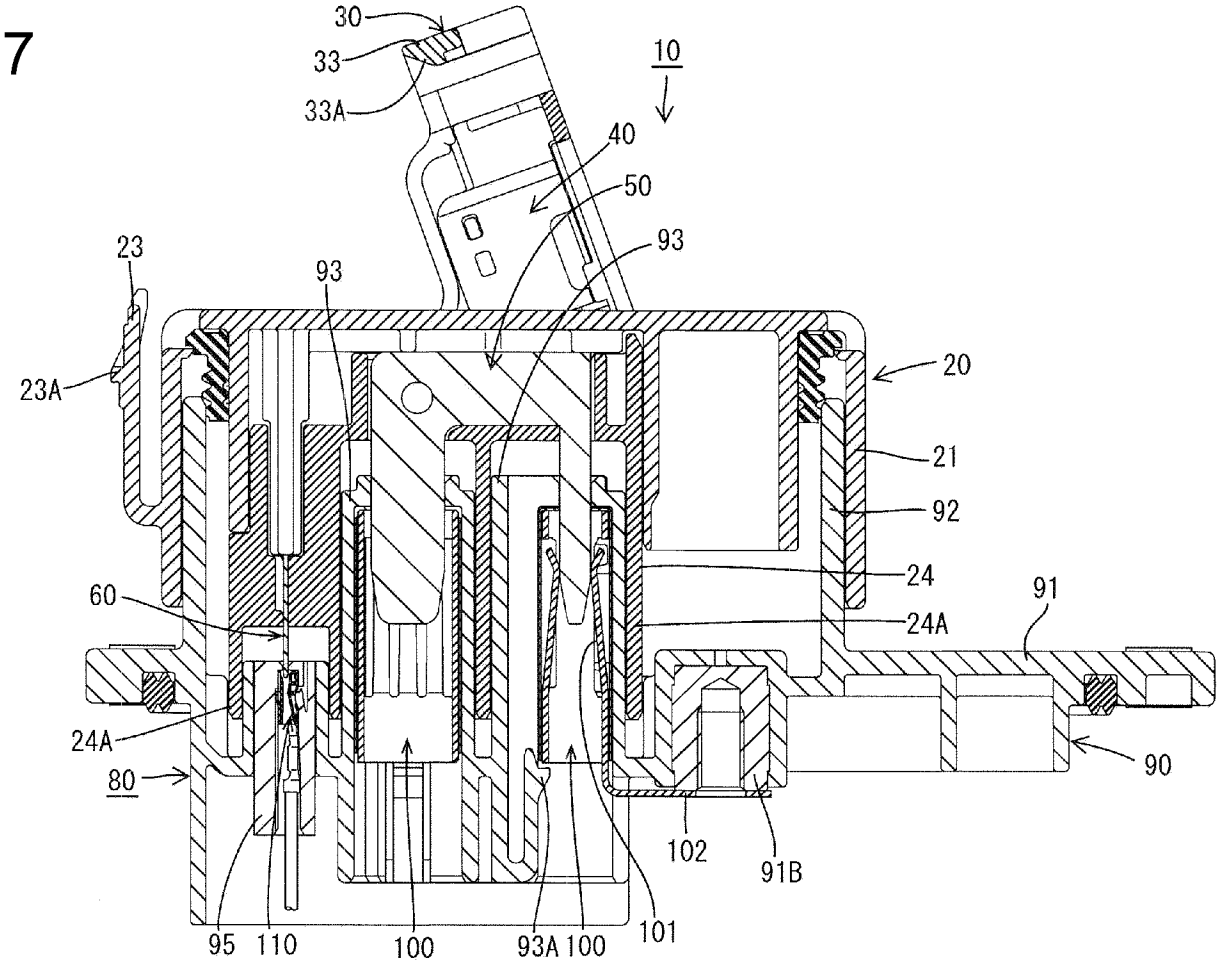
FIG. 27 is a section corresponding to FIG. 9, showing the state immediately after the detection terminal is set in the OFF-state.

A short switching time is required for the relay or another power cutting means to switch the power supply circuit to the cut-off state particularly. To ensure this switching time, a delaying step is provided to stop the rotation of the lever 30 and delay the start of the separation of the heavy current terminals 50. First, as shown in FIG. 18, the contact surfaces 45A of the catches 45 contact the restricting walls 25, so that the rotation of the lever 30 is stopped and the separation of the cover-side connector 10 and the waiting-side connector 80 is interrupted. At this time, the heavy current terminals 50 are fit in the intermediate terminals 100 and the detection terminal 60 remains in the OFF-state where it is separated from the relay-side terminal 110 as shown in FIG. 27.

Figure 28:
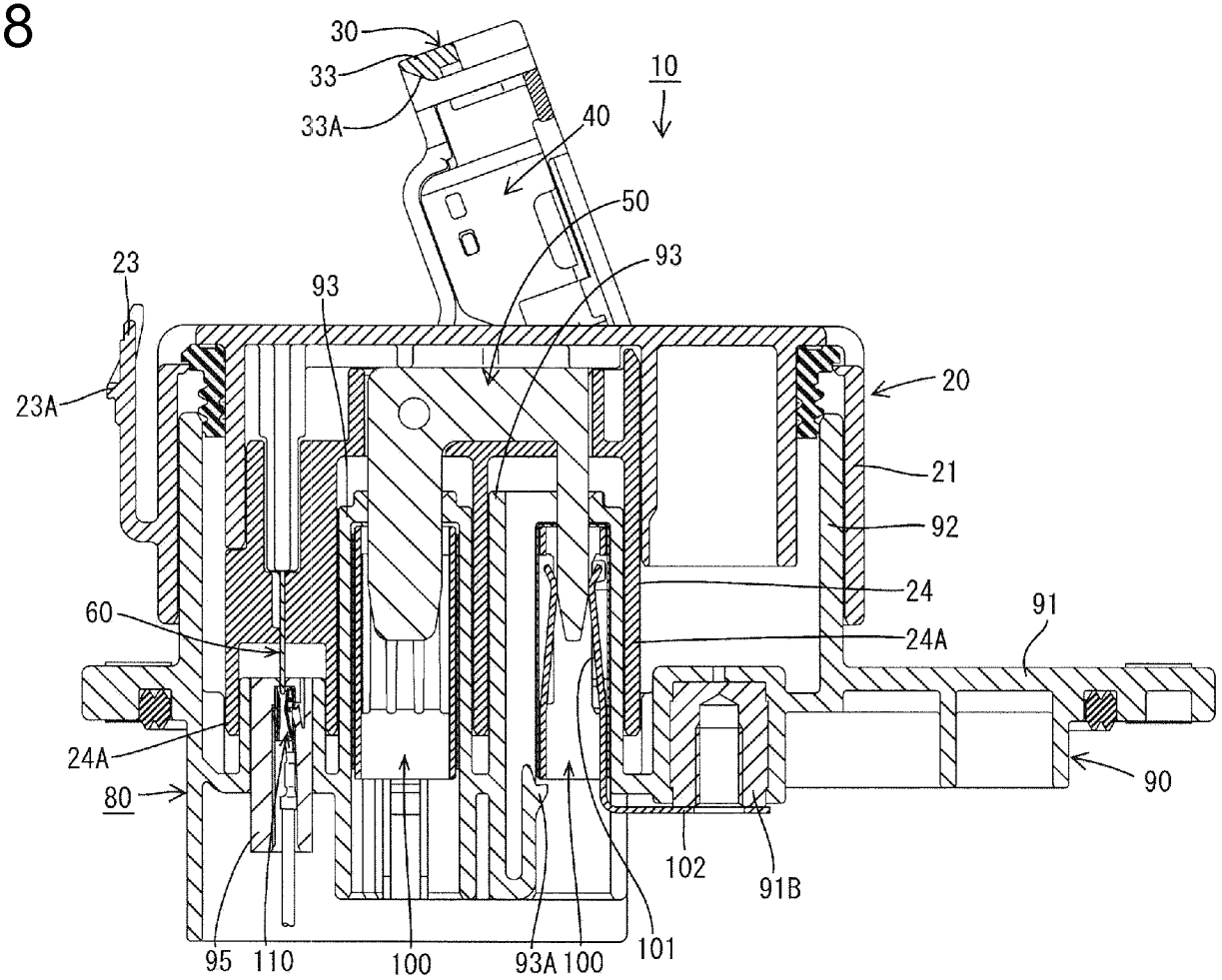
FIG. 28 is a section corresponding to FIG. 10.

The stopper 40 then is displaced from the final position to the initial position as shown in FIG. 19 to resume rotation of the lever 30. If the rotation of the lever 30 is resumed after the stopper 40 reaches the initial position, the contact surfaces 45A of the catches 45 pass above the restricting walls 25 and separation of the cover-side connector 10 and the waiting-side connector 80 is resumed. At this time, the heavy current terminals 50 are fit in the intermediate terminals 100 and the detection terminal 60 remains in the OFF-state where it is separated from the relay-side terminal 110 as shown in FIG. 28.

The partial locking projections 21A hold the lever 30 at the partial locking position 1P to complete the separation of the cover-side connector 10 and the waiting-side connector 80. Further, the stopper 40 is held at the initial position, the heavy current terminals 50 are fit in the intermediate terminals 100 and the detection terminal 60 remains in the OFF-state. Since the power supply circuit has been switched to the cut-off state by the relay at this point of time, there is no possibility of a spark when the heavy current terminals 50 are separated from the intermediate terminals 100 by separating the cover-side connector 10 from the waiting-side connector 80.

As described above, the delaying step prevents the heavy current terminals 50 from being separated from the intermediate terminals 100 to generate a spark until the power supply circuit is switched to the cut-off state by the relay. Specifically, the stopper 40 is provided in the lever 30 and brought into contact with the restricting walls 25 to stop the rotation of the lever 30 and ensure the switching time by the relay. Thus, the power supply circuit can be opened with the power supply circuit set in the cut-off state.

Further, even if the stopper 40 is at a position displaced from the initial position in starting the rotation of the lever 30 at the partial locking position 1P, the engaging surfaces 45B of the catches 45 are engaged with the restricting walls 25 and the stopper 40 is forcibly returned to the initial position. Thus, it can be prevented that the rotation of the lever 30 is hindered and the stopper 40 is separated from the lever 30 due to forcible rotation of the lever 30.

The invention is not limited to the above described embodiment. For example, the following embodiments also are included in the scope of the invention.

Although the rotational lever 30 is illustrated, a slidable lever (having a movement or displacement path different than a rotation path such as a substantially linear or bent path) may be used as a movable member according to the invention.

A configuration to return the stopper 40 at the final position to the initial position as shown in FIG. 29 is illustrated in the above embodiment. However, a configuration to return the stopper 40 at any arbitrary position between the initial and final positions to the initial position may be adopted according to the invention.

Rotation of the lever 30 can be resumed by sliding the stopper 40 from the final position to the initial position in the above embodiment. However, rotation of the lever 30 may be resumed by separating the stopper from the lever 30. That is, the stopper need not be movable relative to the lever 30 and may be mounted at the final position after the lever 30 is rotated to the full locking position. In this case, the stopper is preferably detachably mountable to the lever 30.

What is claimed is:

1. A power supply circuit cut-off device capable of opening and closing a power supply circuit, comprising:

a lever;

a cover that supports the lever movably between a first position and a second position, at least one restricting wall projecting from the cover;

a housing that is connectable to and separable from the cover as the lever is moved, the cover being separated from the housing by moving the lever from the second position to the first position;

at least one power supply terminal that opens the power supply circuit by being disconnected from the power supply circuit in a separating process of the cover;

at least one detection terminal that is switched from an ON-state to an OFF-state in the separating process of the cover; and at least one stopper slidably movable on the lever between an initial position and a final position, the stopper at the final position contacting the at least one restricting wall on the cover to stop a movement of the lever from the second position toward the first position until the stopper is slid from the final position to the initial position, thereby delaying movement of the lever to the first position sufficiently after the detection terminal is switched from the ON-state to the OFF-state to prevent a spark when the power supply terminal is disconnected from the power supply circuit while separating the cover.

2. The power supply circuit cut-off device of claim 1, further comprising at least one relay that cuts off the power supply circuit based on the detection terminal being switched from the ON-state to the OFF-state.

3. The power supply circuit cut-off device of claim 2, wherein the stopper stops the movement of the lever from the fully connected position toward the first position at least until the relay cuts off the power supply circuit.

4. The power supply circuit cut-off device of claim 1, wherein the stopper located at a position different from the initial position returns toward the initial position by being engaged with the restricting wall at an initial stage of connection of the cover and moves from the initial position toward the final position at a final stage of connection of the cover.

5. The power supply circuit cut-off device of claim 1, wherein the restricting wall and the stopper have wall surfaces aligned to move the stopper along the lever from the final position to the initial position as the lever is moved from the first position to the second position for connecting the cover to the housing.

6. The power supply circuit cut-off device of claim 5, wherein the cover has an engaging wall disposed and configured to engage the stopper and slide the stopper along the lever from the initial position to the final position as the lever is moved to the second position for connecting the cover to the housing.

7. The power supply circuit cut-off device of claim 1, wherein the cover has an engaging wall disposed and configured to engage the stopper and slide the stopper from the final position to the initial position as the lever is moved to the second position for connecting the cover to the housing.

8. The power supply circuit cut-off device of claim 1, wherein the cover has at least one supporting pin and the lever being mounted for rotation about the supporting pin.

9. A power supply circuit cut-off device capable of opening and closing a power supply circuit, comprising:

a housing;

a cover that is connectable to and separable from the housing, the cover having at least one restricting wall;

a lever mounted to the cover and movable from a partial locking position to a full locking position for connecting the cover to the housing and being movable from the full locking position to the partial locking position for separating the cover from the housing;

a stopper mounted to the lever and being slidable on the lever between an initial position and a final position;

at least one power supply terminal that opens the power supply circuit by being disconnected from the power supply circuit when separating the cover from the housing; and at least one detection terminal that is switched from an ON-state to an OFF-state when separating the cover from the housing; wherein the stopper contacts the at least one restricting wall at the final position of the stopper on the lever to restrict a movement of the lever from the fully connected position toward the partially connected position until the stopper is slid to the initial position on the lever, the sliding of the stopper from the final position to the initial position causing a delay during separation of the cover from the housing sufficient to prevent a spark when the power supply terminal is disconnected from the power supply circuit after the detection terminal is switched from the ON-state to the OFF-state while separating the cover.

10. The power supply circuit cut-off device of claim 9, wherein the restricting wall and the stopper have wall surfaces aligned to move the stopper from the final position to the initial position as the lever is moved from the partial locking position to the full locking position for connecting the cover to the housing.

11. The power supply circuit cut-off device of claim 9, wherein the cover has an engaging wall disposed and configured to engage the stopper and slide the stopper along the lever from the initial position to the final position as the lever is moved to the partial locking position for connecting the cover to the housing.

* * * * *